US006631970B2

(12) United States Patent
Sato et al.

(10) Patent No.: US 6,631,970 B2
(45) Date of Patent: Oct. 14, 2003

(54) INK JET RECORDING APPARATUS AND INK JET PRINT HEAD

(75) Inventors: Tomonori Sato, Kanagawa (JP); Shinji Takagi, Kanagawa (JP); Kentaro Yano, Kanagawa (JP); Tetsuhito Ikeda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/854,680

(22) Filed: May 15, 2001

(65) Prior Publication Data

US 2002/0021315 A1 Feb. 21, 2002

(30) Foreign Application Priority Data

May 16, 2000 (JP) ..... 2000-143852

(51) Int. Cl.[7] ..... B41J 29/393
(52) U.S. Cl. ..... 347/19; 347/9
(58) Field of Search ..... 347/9, 65, 19, 347/7, 23

(56) References Cited

U.S. PATENT DOCUMENTS

| | | | | |
|---|---|---|---|---|
| 4,313,124 A | | 1/1982 | Hara | 346/140 R |
| 4,345,262 A | | 8/1982 | Shirato et al. | 346/140 R |
| 4,459,600 A | | 7/1984 | Sato et al. | 346/140 R |
| 4,463,359 A | | 7/1984 | Ayata et al. | 346/1.1 |
| 4,469,190 A | | 9/1984 | Yamaguchi | 180/219 |
| 4,558,333 A | | 12/1985 | Sugitani et al. | 346/140 R |
| 4,608,577 A | | 8/1986 | Hori | 346/140 R |
| 4,723,129 A | | 2/1988 | Endo et al. | 346/1.1 |
| 4,740,796 A | | 4/1988 | Endo et al. | 346/1.1 |
| 5,721,574 A | | 2/1998 | Kubby | 347/7 |
| 5,992,984 A | * | 11/1999 | Imanaka et al. | 347/65 |
| 6,109,718 A | | 8/2000 | Murakami et al. | 347/14 |
| 6,116,714 A | | 9/2000 | Imanaka et al. | 347/19 |
| 6,257,694 B1 | * | 7/2001 | Tokumaru et al. | 347/19 |

FOREIGN PATENT DOCUMENTS

| | | | |
|---|---|---|---|
| JP | 54-56847 | 5/1979 | |
| JP | 58-118267 | 7/1983 | |
| JP | 59-123670 | 7/1984 | |
| JP | 59-138461 | 8/1984 | |
| JP | 60-71260 | 4/1985 | |
| JP | 7-256883 | 10/1995 | |
| JP | 9-174880 | 7/1997 | 1/1 |

* cited by examiner

*Primary Examiner*—Stephen D. Meler
*Assistant Examiner*—Lam Nguyen
(74) *Attorney, Agent, or Firm*—Fitzpatrick, Cella, Harper & Scinto

(57) ABSTRACT

An ink jet recording apparatus is provided which can detect ink in a print head highly precisely with a simple construction. The apparatus includes: a detection electrode to detect, through the ink on the ink jet print head board, a voltage change between print elements and drive elements which is produced as the print elements are driven; a periodical driver to drive the print elements at a predetermined drive frequency; a voltage detector to periodically detect an output voltage of the detection electrode at a timing corresponding to the drive frequency; and a state check device to check an ink ejection state of the ink jet print head according to a result of the detection by the voltage detector.

23 Claims, 25 Drawing Sheets

(IMPEDANCE-FREQUENCY CHARACTERISTIC OF CONDUCTIVE INK)

(CONDUCTIVE INK ELECTRIC CHARACTERISTIC EXPERIMENT (1))

(CONDUCTIVE INK ELECTRIC CHARACTERISTIC EXPERIMENT (2))

(CONDUCTIVE INK ELECTRIC CHARACTERISTIC EXPERIMENT (3))

(CONDUCTIVE INK ELECTRIC CHARACTERISTIC EXPERIMENT (4))

(FREQUENCY-IMPEDANCE CHARACTERISTIC OF CONDUCTIVE INK A)

(FREQUENCY-IMPEDANCE CHARACTERISTIC OF CONDUCTIVE INK B)

(FREQUENCY-IMPEDANCE CHARACTERISTIC OF CONDUCTIVE INK C)

(FREQUENCY-IMPEDANCE CHARACTERISTIC OF CONDUCTIVE INK D)

INK JET RECORDING APPARATUS AND INK JET PRINT HEAD

This application is based on Patent Application No. 2000-143852 filed May 16, 2000 in Japan, the content of which is incorporated hereinto by reference.

BACKGROUND OF THE INVENTION

1. Field of the Invention

The present invention relates to an ink jet recording apparatus which ejects ink from a print head onto a recording sheet to record an image or the like, and more specifically to an ink jet recording apparatus and an ink jet print head which have a status detection function to detect a state of the print head or, in more specific terms, a state of the ink in the print head.

2. Description of the Related Art

Recording apparatus with functions of printer, copying machine and facsimile, combination type recording apparatus including computers and word processors, and recording apparatus used as output devices for work stations are all designed to record an image on a recording sheet, such as paper and plastic thin plate (for OHP, for example), according to image data. Such recording apparatus can be classed into an ink jet type, wire dot type, thermal recording type, thermal imprint type, and laser beam type according to the recording method of the printing means used.

Of these recording methods, the ink jet type recording apparatus (ink jet recording apparatus) ejects ink from the ink jet print head (also referred to simply as a print head) as a printing means onto a recording medium such as a recording sheet to form an image and has the advantage of being able to easily reduce the size of the printing means and print a very fine image at high speed. Other advantages include a low running cost because it can print on plain paper with no special treatment, low noise during printing operation because the ink jet recording apparatus employs a non-impact printing method, and ease with which multicolor inks can be used in forming a color image.

FIG. 24 is a block diagram schematically showing a system configuration in a conventional ink jet recording apparatus.

In the figure, a main controller 11 has a CPU and constitutes a main controller of the ink jet recording apparatus. The main controller 11 converts image data sent from a host computer 10 into pixel data and stores them in a frame memory 12. The main controller 11 also supplies each pixel data stored in the frame memory 12 to a driver controller 17 at a predetermined timing. The driver controller 17 converts the pixel data received into drive data for driving print elements 101 (data for turning on or off the print elements 101 in an ink jet print head board 100). The converted drive data is stored in a drive data RAM 18. According to a control signal output from the main controller 11, the driver controller 17 reads the drive data from the drive data RAM 18 and feed it to a head driver 102 to control the drive timing of the print elements 101.

In the following configuration, the main controller 11 controls the ejection of a conductive ink 50 from the print elements 101 installed in the ink jet print head board 100, the rotation of a carriage feed motor 15 and the rotation of a paper feed motor 16. This control is performed by the main controller 11 controlling the driver controller 17 and motor drivers 13 and 14, thus recording characters and images corresponding to the image data.

The ink jet recording method described above has some ink ejection variations. One such variation is a bubble jet recording method. In this method a heater is installed in each nozzle to impart a thermal energy to the ink in the nozzle to generate a bubble in the ink. The bubble generating energy is used to eject ink from the nozzle. The heater as a print element to generate an energy for ejecting ink may be manufactured by using the semiconductor fabrication process. Hence, the ink jet print head using the bubble jet recording method has the print elements formed on a print head board, which is made from a silicon substrate and bonded with a top plate. The top plate, which is made of resin, such as polysulfone, and glass, is formed with grooves serving as ink passages.

Taking advantage of the fact that the print head board is made from a silicon substrate, not only the print elements but also other functional components are formed on the print head board. The functional components include, for example, a driver for driving the print elements, a temperature sensor used to control the print elements according to the temperature of the print head, and a drive controller for the temperature sensor.

Japanese Patent Application Laying-open No 7-256883 discloses an example of the ink jet print head board described above. The construction of the conventional ink jet print head board disclosed in the above official gazette is shown in FIG. 25.

In FIG. 25, on the ink jet print head board 100 (simply referred to as a board) are arranged heaters 101 as print elements that apply an ink ejection thermal energy to the ink. Power transistors (driver elements) 102 are connected to the parallelly arranged heaters (print elements) 101 to drive the heaters 101.

Also formed on the board 100 are a shift register 104, a latch circuit 103, and a plurality of AND gates 115. The shift register 104 receives image data from outside through a terminal 106 in synchronism with a serial clock received from a terminal 105, and holds image data representing one line.

The latch circuit 103 latches the image data for one line parallelly output from the shift register 104 in synchronism with a latch clock (latch signal) received through a terminal 107, and transfers the image data parallelly to the power transistors 102. The AND gates 115 are provided in one-to-one relationship with the power transistors 102 and apply output signals of the latch circuit 103 to the power transistors 102 in response to an external enable signal.

Denoted 108 is a drive pulse width input (heat pulse) terminal which receives from outside the print head a signal for controlling an ON time of the power transistors 102 as drive elements, i.e., the time during which to apply current to the heaters 101. Designated 109 is a terminal for inputting a drive power (5V) for logic circuits such as the latch circuit 103 and shift register 104. The board 100 also has a ground terminal 110 and terminals 112 for driving a sensor 114 and for a monitor. The terminals 105–112 formed on the board 100 are input terminals to receive the image data and various signals from outside.

Also formed on the print head board 100 is a sensor 114 such as a temperature sensor for measuring the temperature of the print head board 100 and a resistance sensor for measuring a resistance of each heater 101. The head having the driver, temperature sensor and their driving controller all formed on the print head board has already been put to practical use, contributing to improving the reliability of the print head and to reducing the size of the recording apparatus.

In this construction, the image data entered as a serial signal is converted into a parallel signal by the shift register 104, and the converted image data is held in the latch circuit 103 in synchronism with the latch clock. In this state, when a drive pulse signal for the heaters 101 (enable signal for the AND gates 115) is entered through the input terminal 108, the power transistors 102 are turned on according to the image data. Electric current flows to those heaters 101 that correspond to the turned-on power transistors 102, causing these heaters 101 to generate a thermal energy.

The print head board 100 is bonded with the top plate to form liquid passages (or nozzles) for ejecting ink and a common liquid chamber communicating with the liquid passages. In this construction, the ink accommodated in the ink tank (or ink container) is supplied through the common liquid chamber to the nozzles. The thermal energy generated by the heaters as they are driven, as described above, heats the ink in the liquid passages (nozzles) and eject it in the form of ink droplets from ejection ports at the tips of the nozzles.

One of important requirements to ensure stable printing is that the ink always exists stably in the common liquid chamber and in each nozzle. That is, when the amount of ink in the ink tank is running low, when air mixes into the nozzles from the nozzle tips, or when bubbles in the common liquid chamber move into the nozzles, it is difficult to eject ink stably, leading to a possible degradation of printing quality.

Consider a case, for example, where some particular nozzles in the ink jet print head fail to eject ink stably. In this case, portions in a printed image where the printing is not performed normally by these failed nozzles appear as distinguishable lines. Further, when the ink in the common liquid chamber is running low, the ink may not be supplied to some nozzles. In that case, too, these nozzles fail to eject ink, degrading the printing quality.

To detect the occurrence of a partial ink ejection failure with some nozzles in the print head, a method has been proposed for detecting the state of the ink, or more specifically the presence or absence of the ink, in the common liquid chamber and nozzles.

Japanese Patent Application Laying-open No. 58-118267, for example, proposes a method for detecting the presence or absence of ink in each of the nozzles arranged in the ink jet print head. With this method, to detect the presence or absence of ink in each nozzle, a temperature detection element whose resistance changes according to heat is installed in each nozzle in addition to the print element. When the ink in the nozzle runs out, the rate of temperature increase near the nozzle becomes large due to the heat of the heater as the print element. The rate of temperature increase is measured by the temperature detection element to detect the presence or absence of ink.

In the construction disclosed in the Japanese Patent Application Laying-open No. 58-118267, a temperature detection element or sensor needs to be installed in each nozzle to be able to check the temperature near the nozzle. It is also necessary to install either in each nozzle or on the print head board a drive element for driving the temperature detection element or sensor. Such a construction can effectively be applied to a print head which has a relatively large nozzle size and in which the nozzles are arranged with a relatively low density.

In recent years, however, a faster and finer recording is being called for. To meet this demand, efforts are being made every year to achieve a higher printing density by increasing the number of nozzles arranged in the ink jet print head and arranging the nozzles at an increased density.

In the ink jet print head board with such densely arrayed nozzles, it is becoming harder to install in or around the nozzles the temperature detection elements or sensors that correspond to the print elements. Arranging on the board the drive elements for driving the temperature detection elements or sensors is also getting more difficult. The same can be said of the case where the number of nozzles is increased. That is, increasing the number of nozzles arranged on the board results in an increase in the number of elements, which in turn leads to an increased size of the chip on the ink jet print head board or to multiple layers of wiring for electrically connecting the sensor elements and other circuits. This in turn complicates the structure on the board and increases the cost of chip manufacture.

The Japanese Patent Application Laying-open No. 58-118267 does not describe the structure of a detection terminal that electrically connects each temperature detection element to the outside of the head. If the detection terminals provided one for each print element are to be arranged on the board, the total number of terminals required of the head increases. This arrangement also increases not only the number of wires of a flexible board used to electrically connect the head to the recording apparatus but also the number of devices on the recording apparatus body for individually controlling signals to be fed to these wires. Providing the detection terminals on the board therefore leads to an increased size of various parts of the apparatus, making it difficult to avoid a cost increase.

Further, because the construction disclosed in the Japanese Patent Application Laying-open No. 58-118267 employs a temperature change detection technique, the printing methods that can apply this detection technique is limited to those which use the thermal energy generating heaters as the print elements.

SUMMARY OF THE INVENTION

It is an object of the present invention to provide an ink jet recording apparatus of a simple construction which can detect ink in the print head with high accuracy.

In one aspect, this invention provides an ink jet recording apparatus having an ink jet print head board mounted on an ink jet print head, the ink jet print head ejecting a conductive ink from ejection ports to perform printing, the ink jet print head board comprising: print elements to supply an energy for ejecting the ink; drive elements to drive the print elements; an insulating protective film formed to cover wires connecting the print elements and the drive elements; a detection electrode capable of detecting, through the ink on the ink jet print head board, a voltage change between signal sources and the drive elements which is produced as the print elements are driven; a periodical drive means to drive the print elements at a predetermined drive frequency; a voltage detection means to periodically detect an output voltage of the detection electrode at a timing corresponding to the drive frequency; and a state check means to check a state of the ink jet print head according to a result of the detection by the voltage detection means.

The impedance of the ink may be set to a constant, lowest value in a frequency band higher than a predetermined frequency. In that case, the periodical drive means preferably drives the print elements at a frequency corresponding to the frequency characteristic of the conductive ink.

The ink state check means may determine whether or not a sufficient amount of the ink to enable appropriate ink ejection is supplied to the ink jet print head board by checking whether the detected voltage output from the voltage detection means is higher than a predetermined voltage value.

In another aspect, this invention provides an ink jet print head which includes: an ink jet print head board; and a top plate combined with the ink jet print head board to form nozzles each corresponding to a predetermined number of the print elements.

In the invention having the construction described above, when a state detection instruction is entered, the print head board drives the print elements at a frequency within a frequency band in which the ink impedance is small. This causes the detected voltage to be output from the detection electrode through the ink present on the ink jet print head board. The value of the detected voltage varies greatly depending on whether there is ink or not. The voltage detection means samples the value of the detected voltage at a timing corresponding to the drive frequency and performs the ink state detection according to the voltage value obtained. This allows the voltage detection to be performed while avoiding noise that occurs periodically according to the drive frequency. Based on the detected voltage, the state check means checks the ink state. Hence, the value of the detected voltage output from the detection electrode changes greatly according to the amount of ink supplied. Because it does not contain noise, the detected voltage value has a good signal-to-noise ratio. Therefore, the state of the print head, more specifically the ink state in the print head, can be detected based on the voltage value with an excellent precision.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now embodiments of this invention will be described.

First Embodiment

A first embodiment of this invention will be explained by referring to FIG. 1 through FIG. 20.

Figure 1:
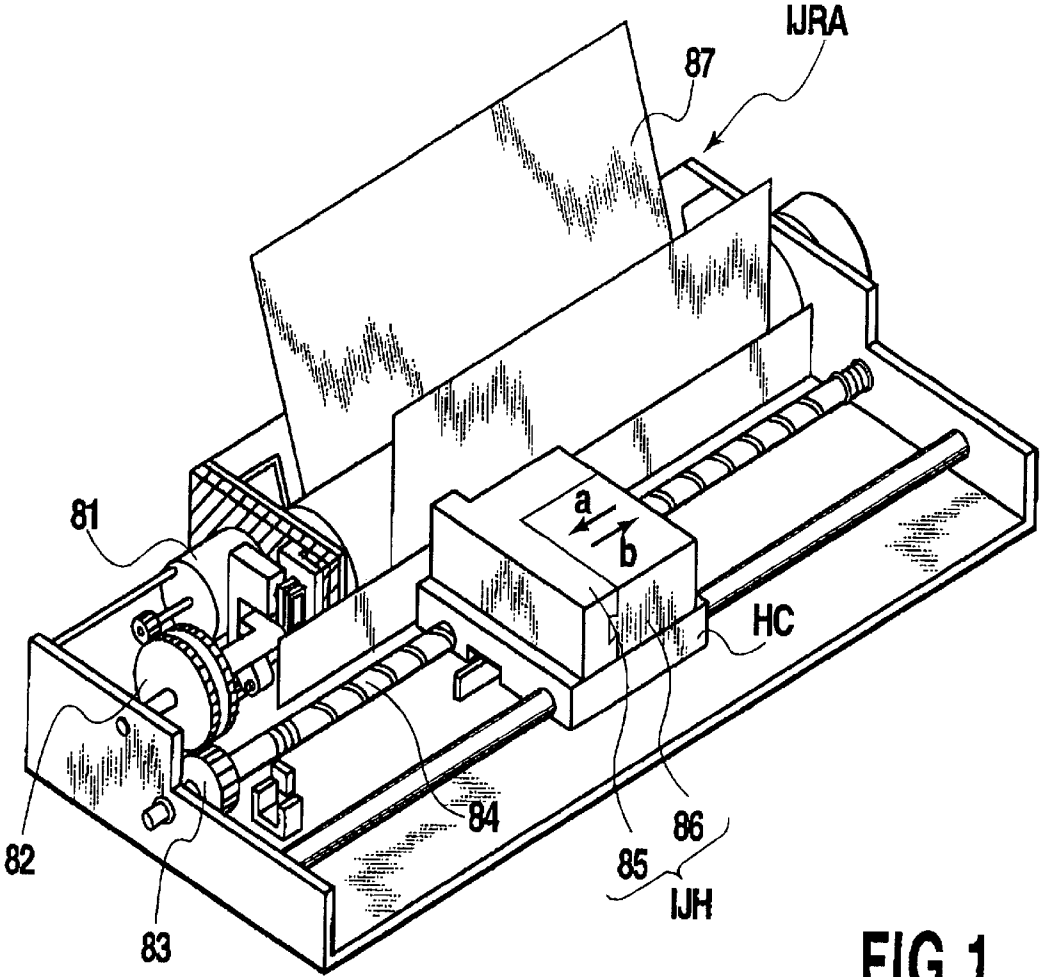
FIG. 1 is a perspective view showing an outline construction of an ink jet recording apparatus applying the present invention.

FIG. 1 is an external perspective view schematically showing main portions of the ink jet recording apparatus IJRA applied to the embodiment of the invention.

In the figure, a lead screw 84 is rotated forwardly or reversely by the forward or reverse rotation of a drive motor 81 through drive force transmission gears 82, 83. A carriage HC has a pin (not shown) that engages a spiral groove of the lead screw 84 so that the carriage HC is reciprocally moved in the direction of arrow a or b in the figure according to the rotation direction of the lead screw 84. On this carriage HC is mounted a head cartridge IJH having an ink jet print head 85 and an ink tank 86. The ink jet recording apparatus IJRA shown in FIG. 1 is the one generally called a serial printer.

This printing apparatus IJRA alternately repeats a main scan of the carriage HC in the direction of arrow a or b and a subscan of a recording sheet 87 or a recording medium to be printed on.

Figure 2:
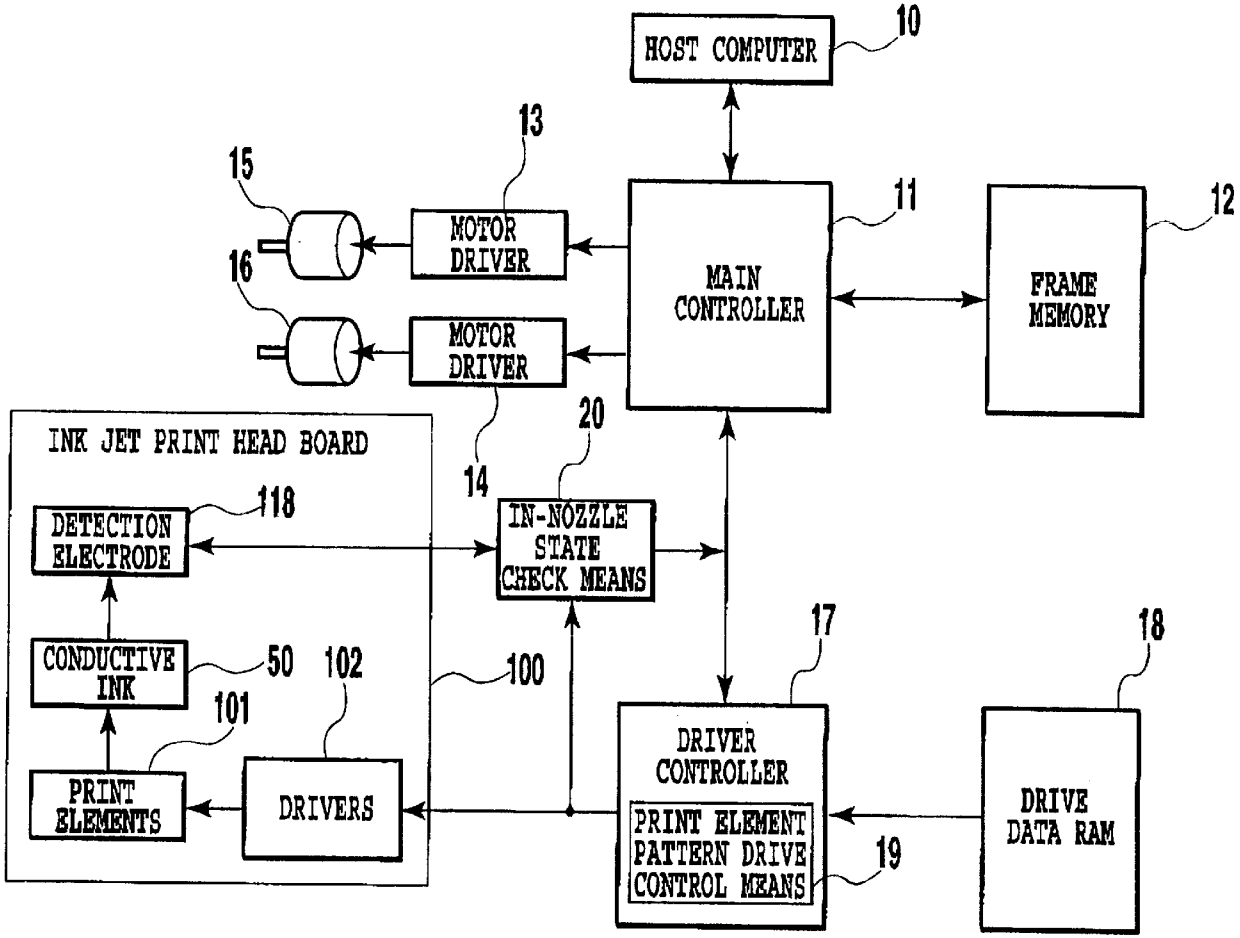
FIG. 2 is a block diagram schematically showing an overall construction of the ink jet recording apparatus of the invention.
Figure 24:
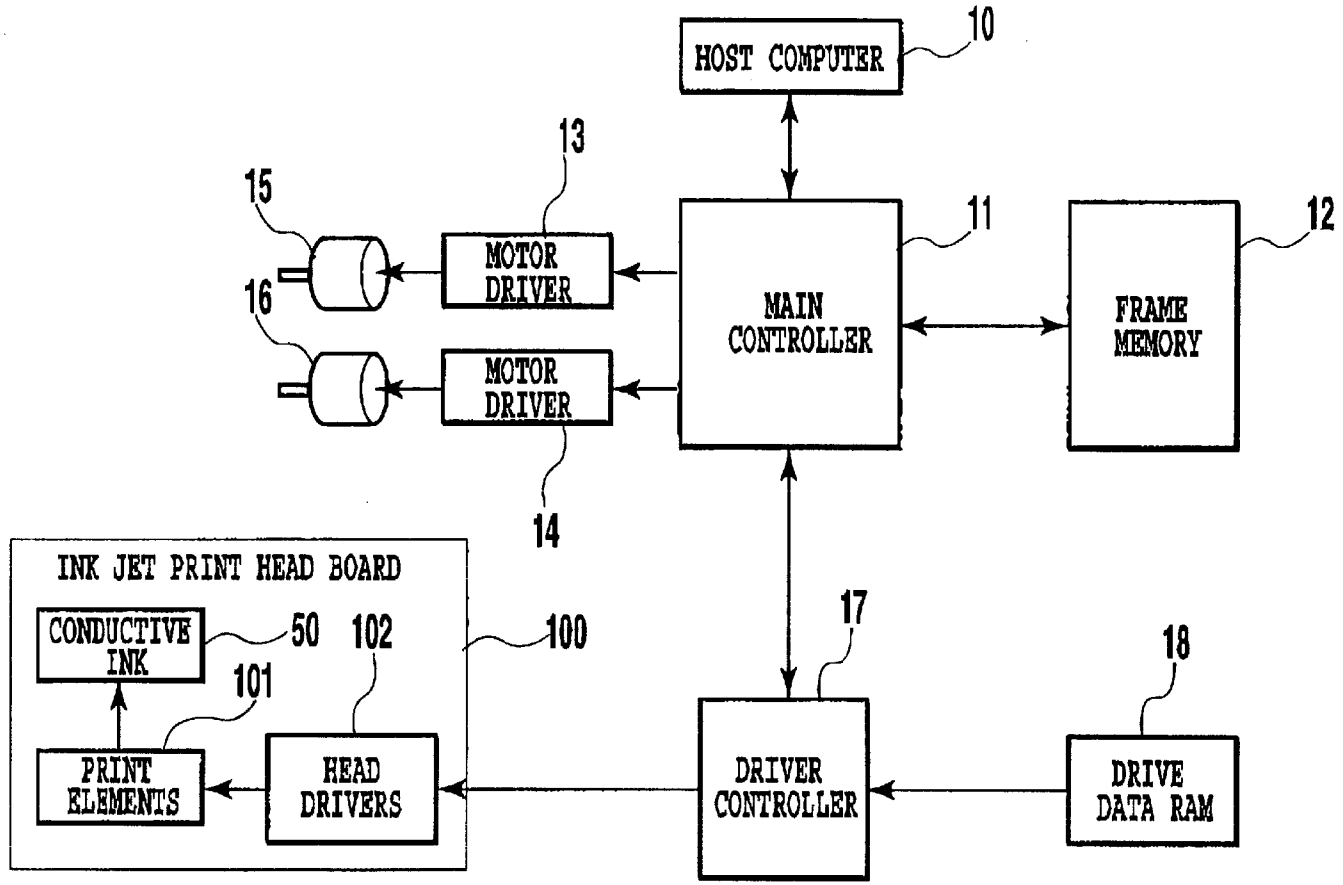
FIG. 24 is a block diagram schematically showing an overall construction of a conventional ink jet recording apparatus.

FIG. 2 is a block diagram schematically showing an overall configuration of the ink jet recording apparatus IJRA of the first embodiment. In the figure, constitutional elements identical with or corresponding to those of the conventional apparatus explained earlier (see FIG. 24) are assigned like reference numbers.

The ink jet recording apparatus shown here differs from the conventional ink jet recording apparatus in that the ink jet print head board 100 is so constructed as to detect through conductive ink 50 a change in the voltage between a print element 101 and a driver 102 when the conductive ink 50 exists on a protective film 405 over wires (see FIG. 6); that a print element pattern drive control means 19 to control the driver when detecting the state of the ink is added to the driver controller 17; and that an in-nozzle state check means (voltage detection means) 20 is added between the ink jet print head board 100 and the main controller 11.

The ink jet recording apparatus of this construction can not only perform the normal printing of characters and images, as with the conventional ink jet recording apparatus, but also detect the state of the conductive ink in the ink jet print head board 100.

That is, for the normal printing of characters and images, the main controller 11 converts the image data sent from the host computer 10 into pixel data which is then stored in a frame memory 12. The main controller 11 supplies the pixel data stored in the frame memory 12 to the driver controller 17 at a predetermined timing. The driver controller 17 converts the received pixel data into drive data (data for turning on or off the print elements 101 in the ink jet print head board 100), which is then stored in a drive data RAM 18. The driver controller 17, according to a control signal from the main controller 11, reads the drive data from the drive data RAM 18 and feeds it to the driver 102 and at the same time controls the drive timing of the driver 102. With the above operation the characters and images corresponding to the image data are printed.

Figure 3:
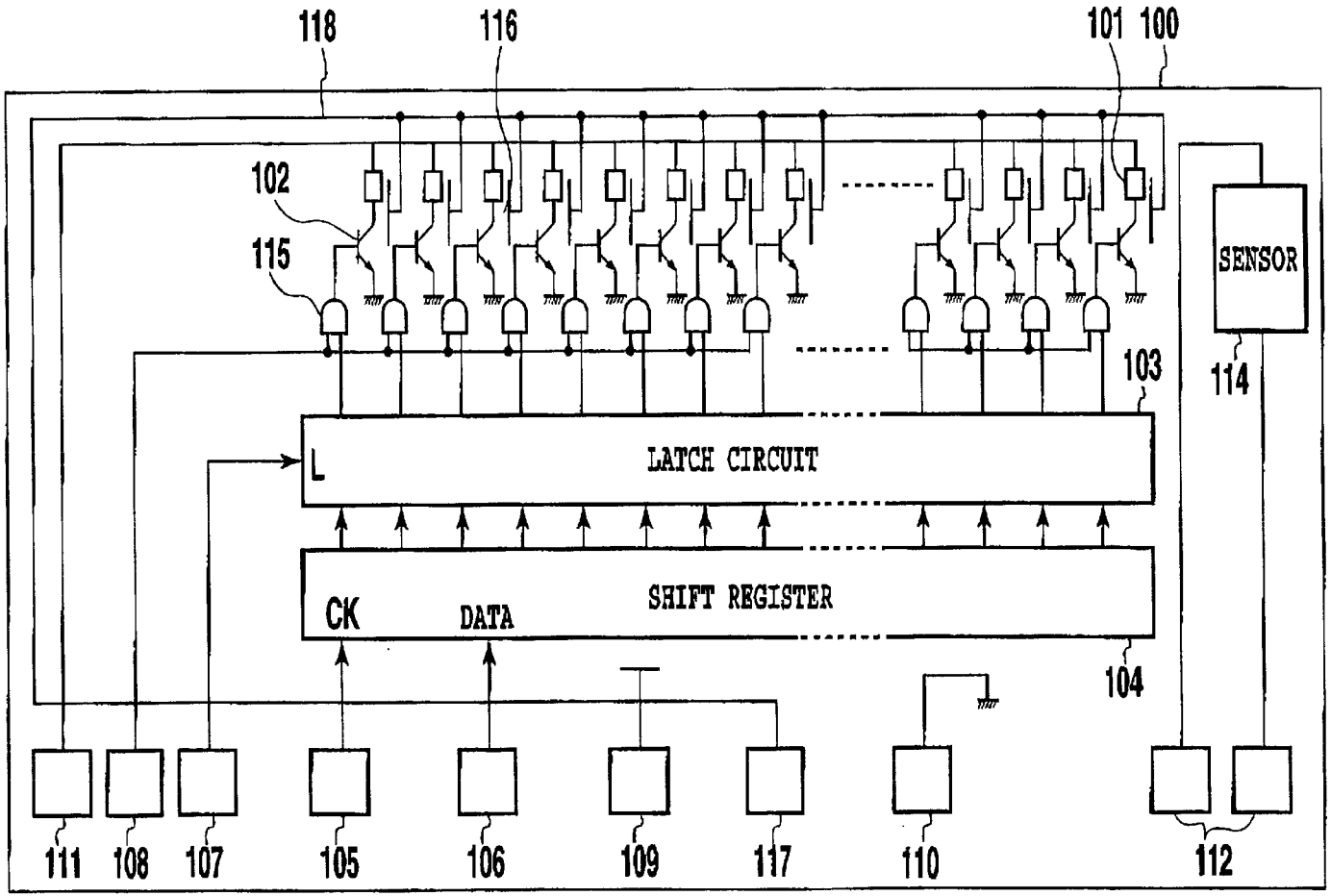
FIG. 3 is a plan view showing an electric schematic construction of an ink jet print head board applying the invention.

The construction of the ink jet print head board that applies this invention will be explained with reference to FIG. 3. FIG. 3 shows only one example construction of main components necessary for the explanation of this invention and it should therefore be noted that the construction of elements and terminals and their numbers are not limited to those shown in FIG. 1.

Figure 7:
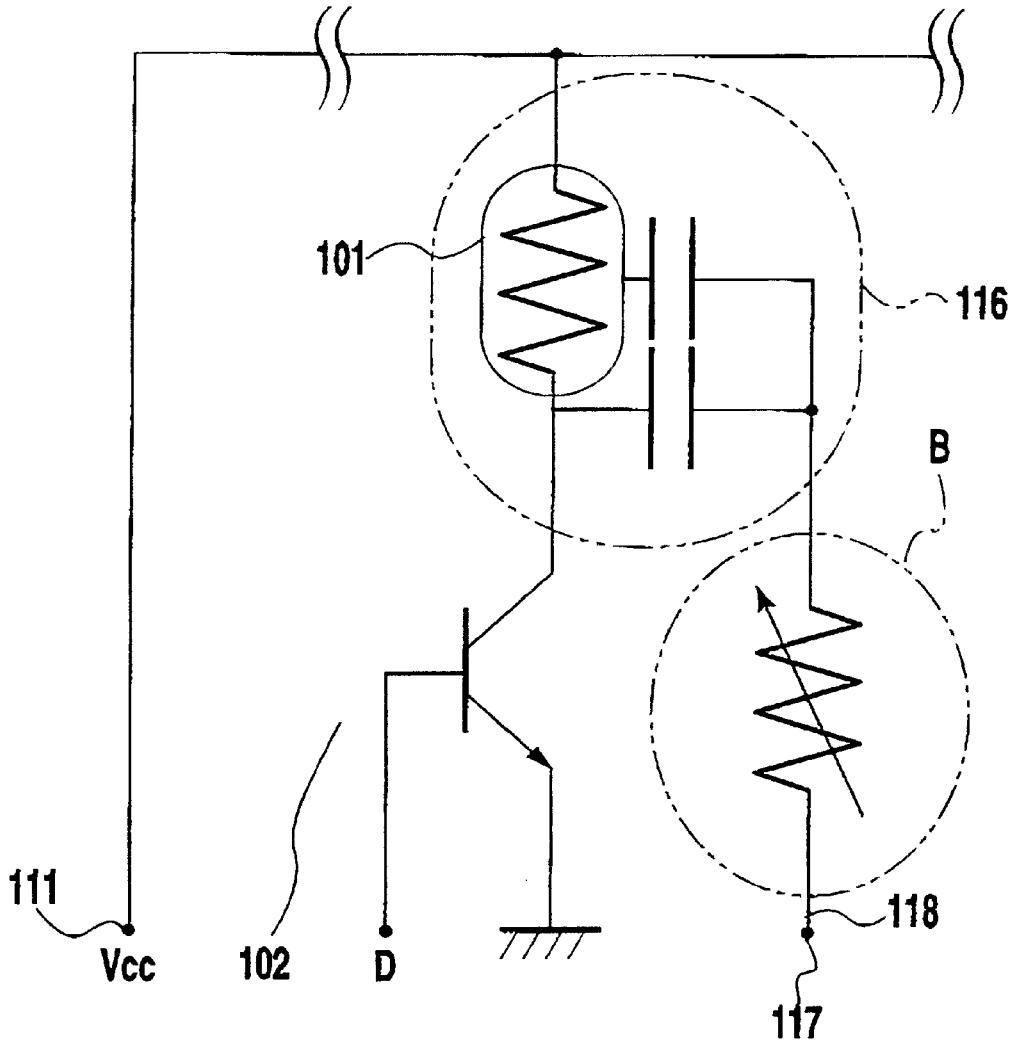
FIG. 7 is a conceptual diagram of an ink detection circuit formed in the ink jet print head board according to a first embodiment of the invention.
Figure 25:
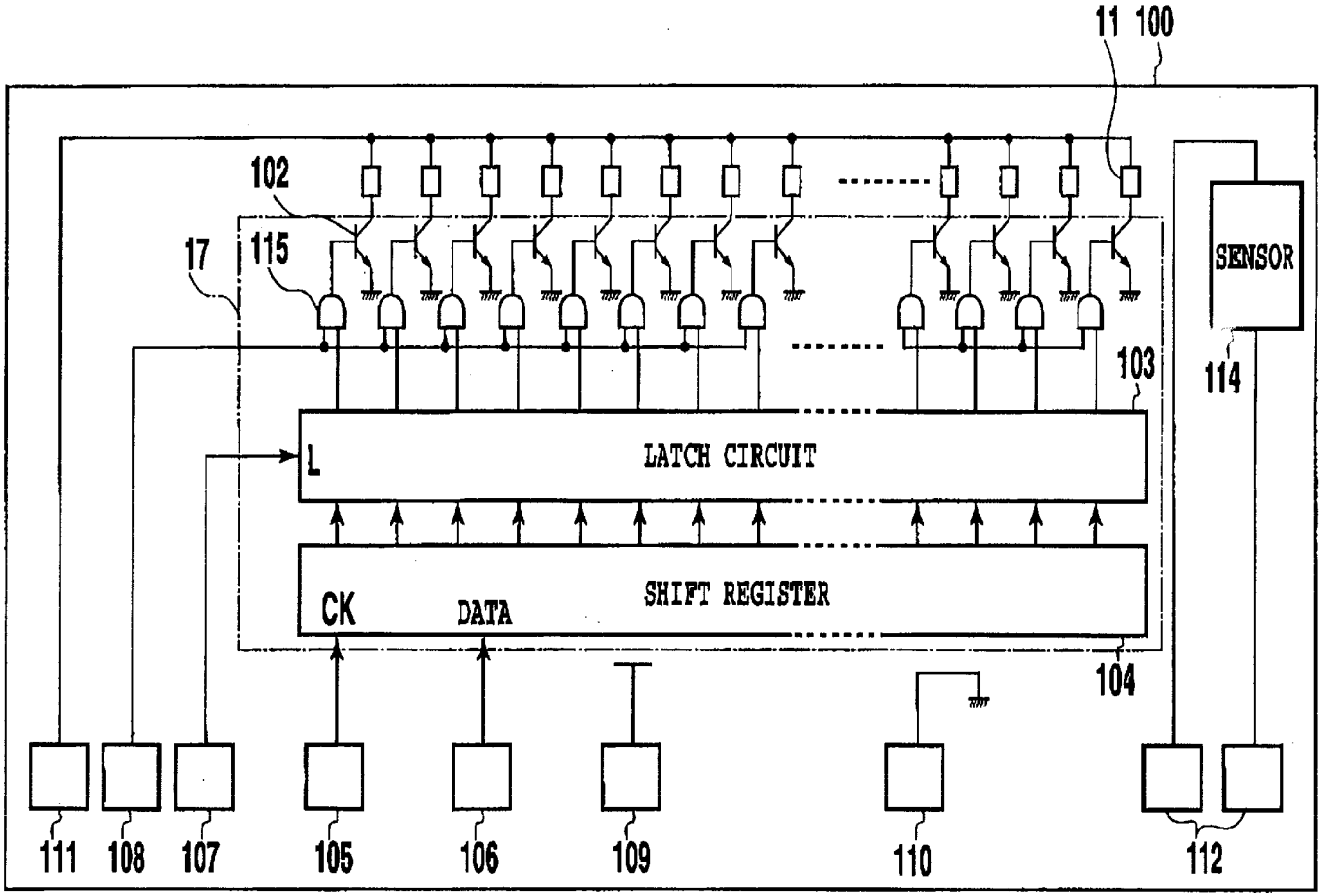
FIG. 25 is a plan view showing an electric schematic construction of a conventional ink jet print head board.

The basic construction of the ink jet print head board shown in FIG. 3 is an ink detection electrode 118 added to the conventional ink Jet print head board 100 of FIG. 25. It is clearly seen from the figure that this construction can implement the invention without significantly increasing the complexity compared with the conventional one. The detection electrode 118, as described later, is AC-coupled to a drive circuit of the heater 101 through a protective film 405, a cavitation resistant film 205 and ink in the nozzle. Denoted 116 is an AC-coupled portion which, as shown in FIG. 7, forms a capacitor in an equivalent circuit. A portion B enclosed by a two-dot chain line in FIG. 7 represents a portion within the nozzle whose electric resistance changes according to the amount of ink present. Denoted D in FIG. 7 is a drive signal from an AND gate 115.

Next, the basic construction of the invention and the principle of ink detection in each nozzle will be explained by referring to FIGS. 4, 5, 6 and 7.

Figure 4:
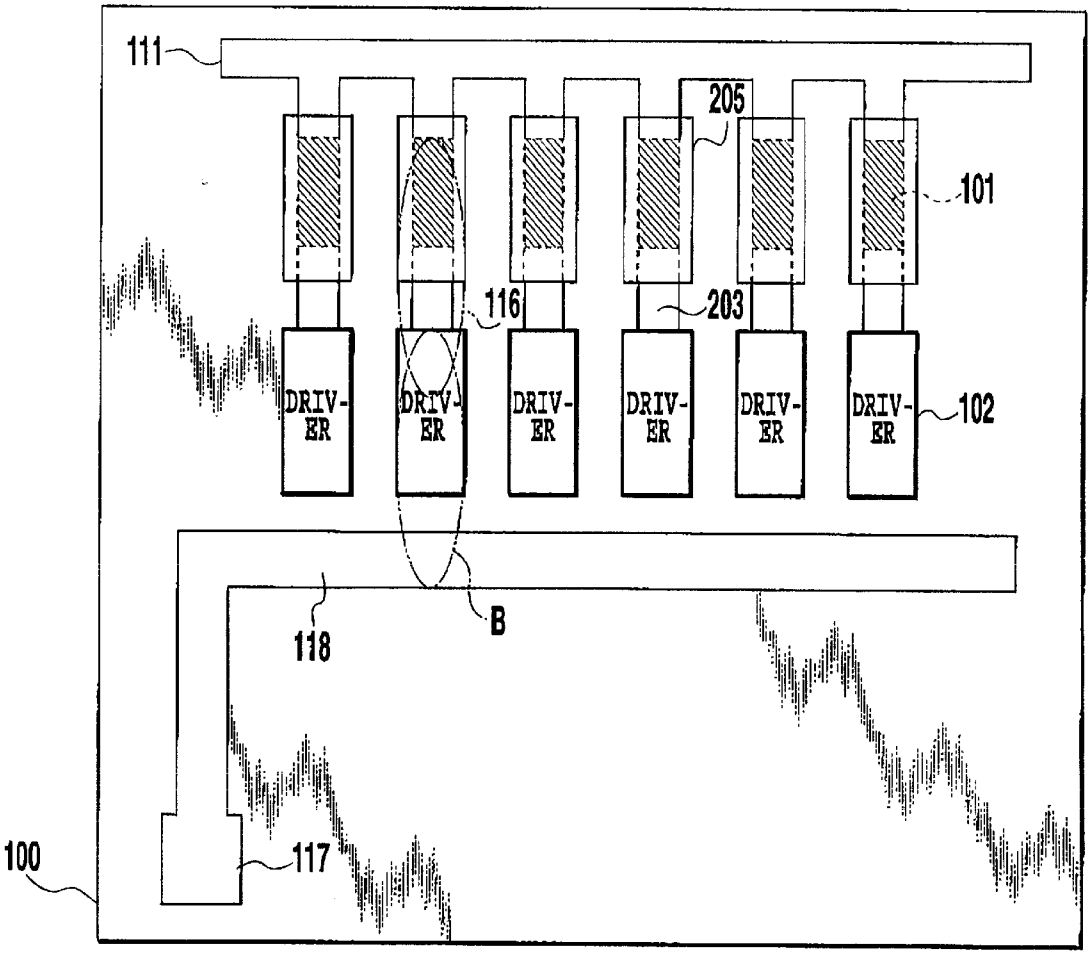
FIG. 4 is a plan view showing a schematic construction of an essential part of the ink jet print head board of FIG. 1.
Figure 5:
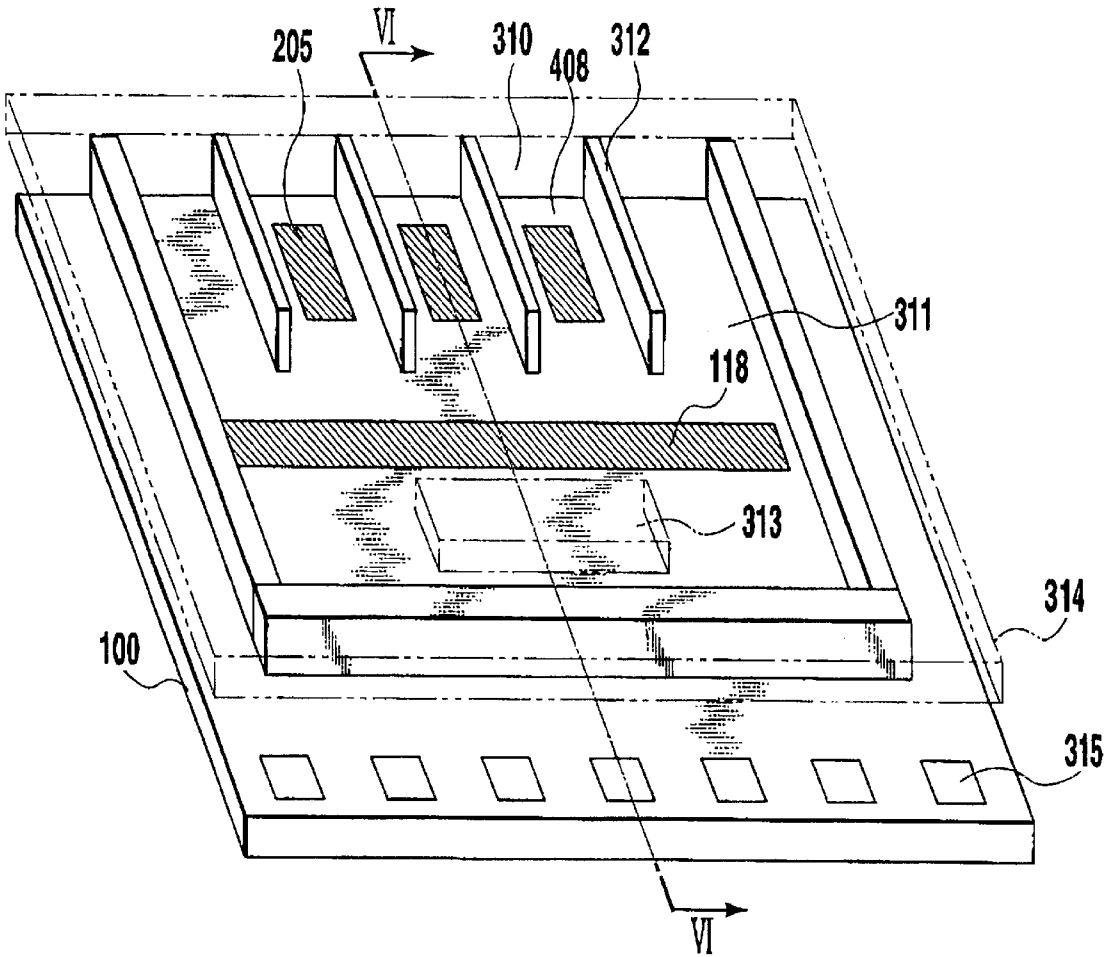
FIG. 5 is a schematic perspective view showing the ink jet print head board of FIG. 1 bonded with a top plate to form nozzles.
Figure 6:
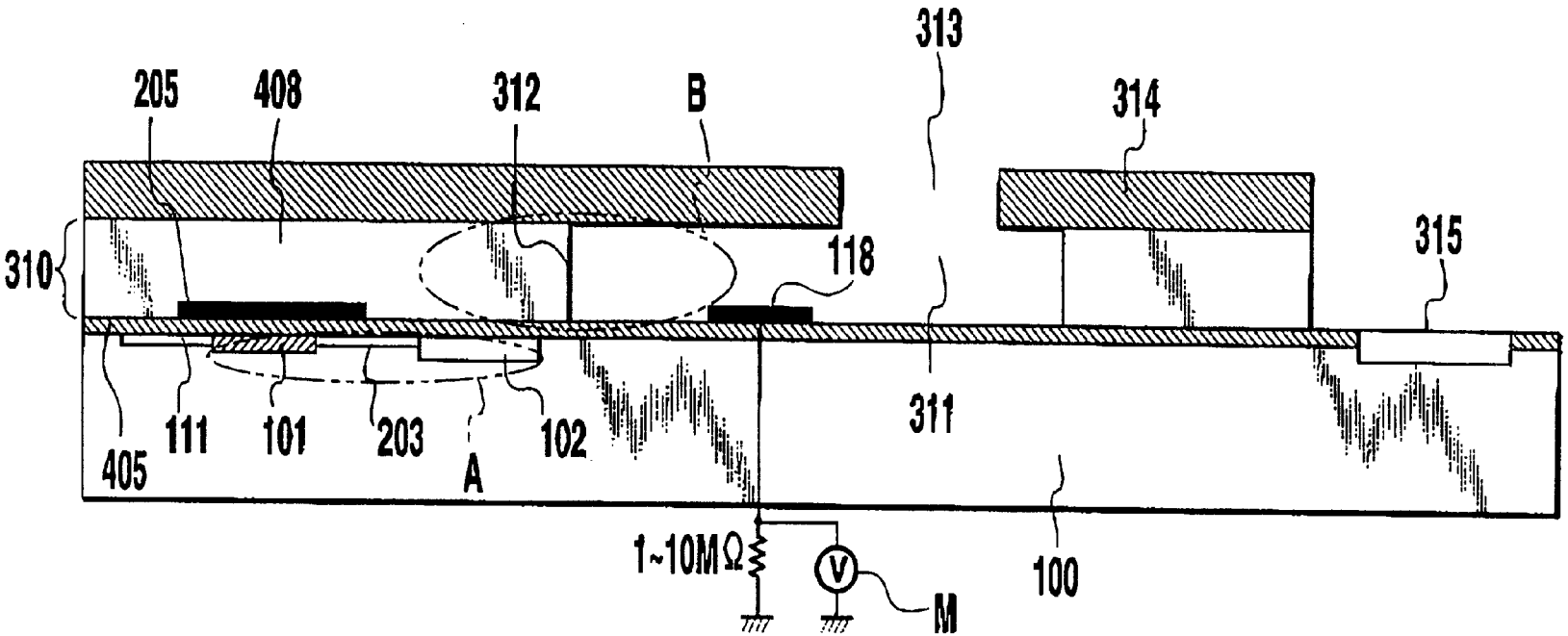
FIG. 6 is a cross section of a nozzle and its associated components, taken along the line VI—VI of FIG. 5.
Figure 8:
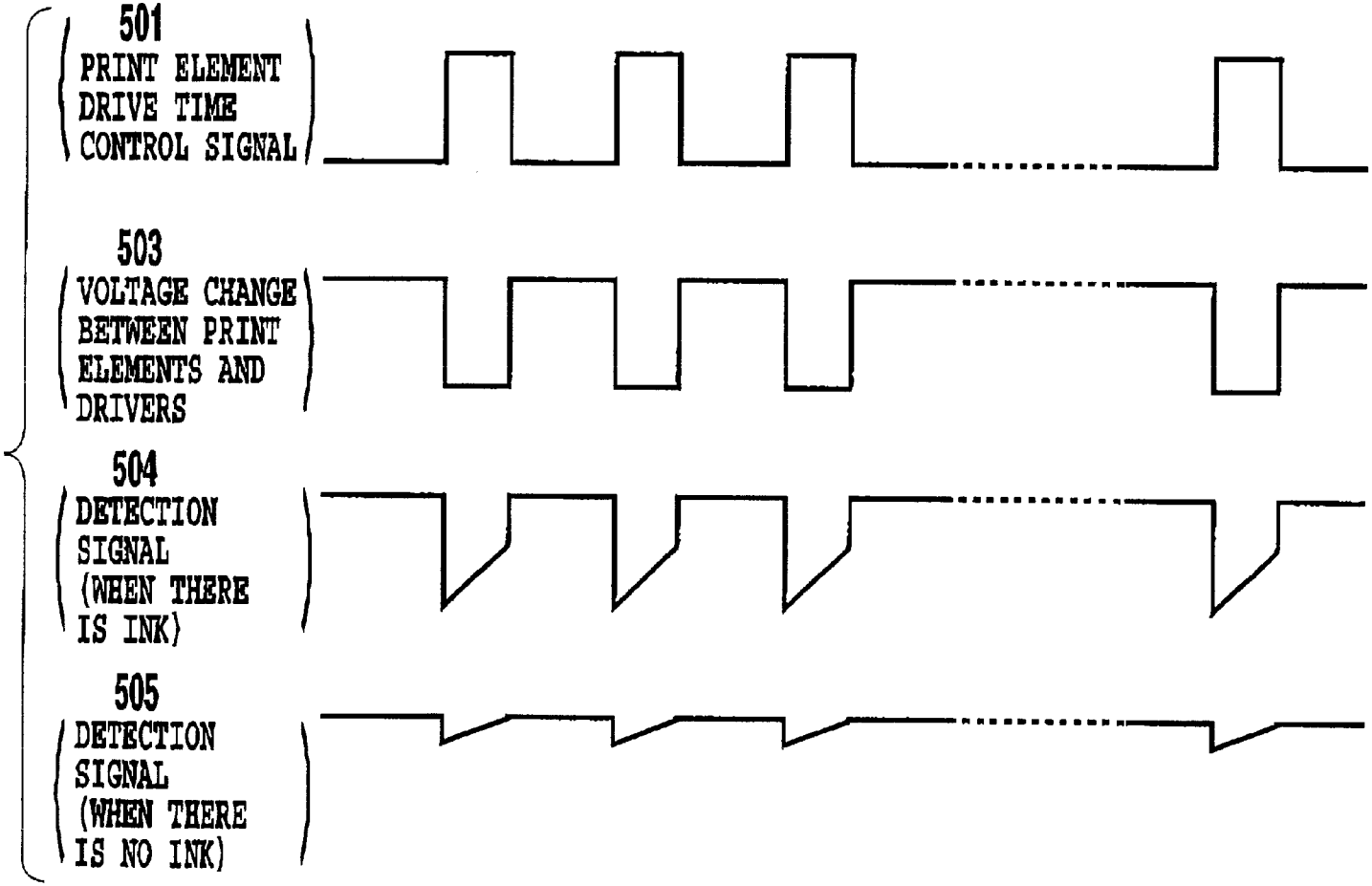
FIG. 8 is a timing chart showing a print element drive timing, an ink state detection timing and a detection signal for the ink jet print head board of FIG. 7.
Figure 9:
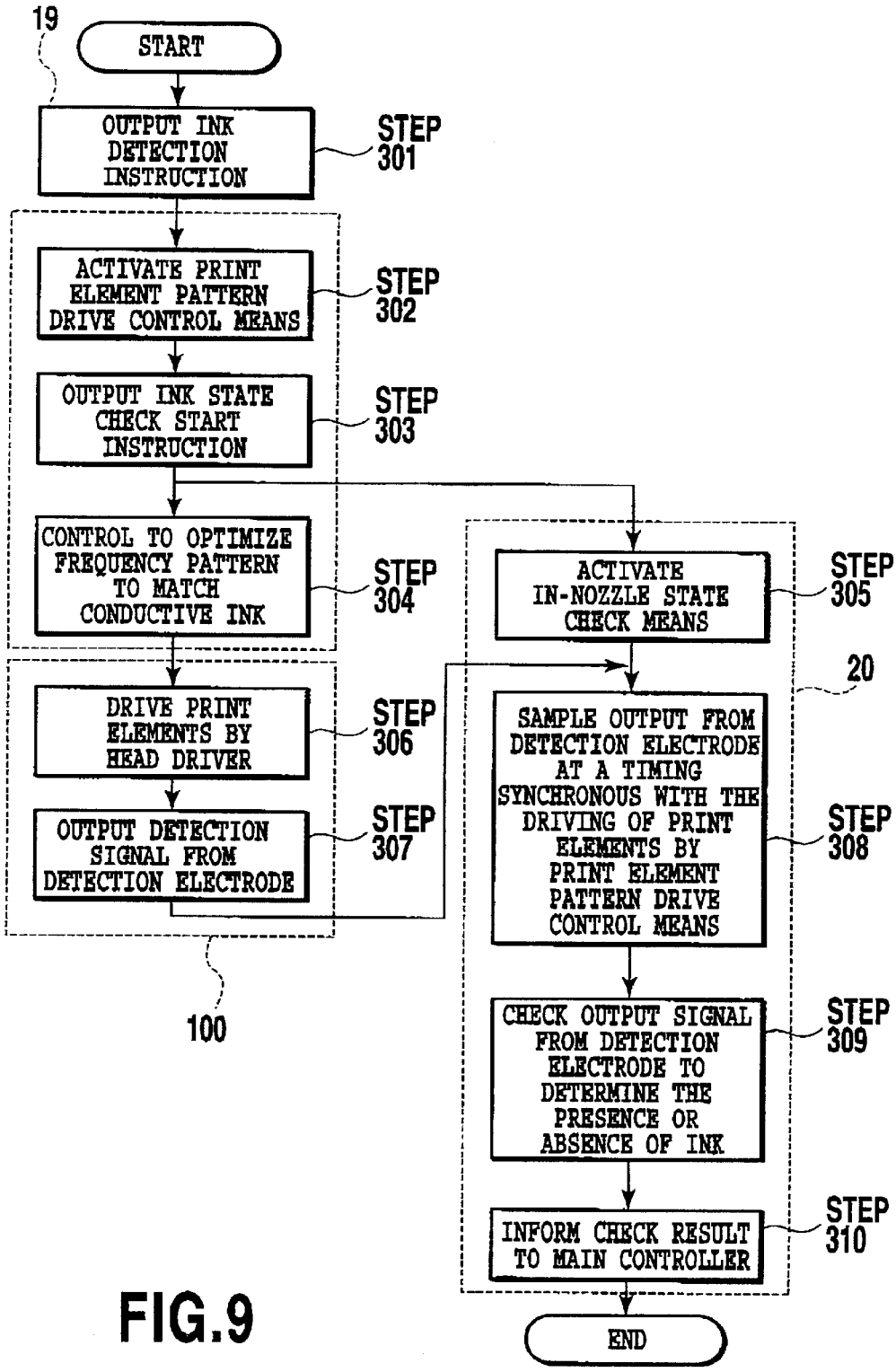
FIG. 9 is a flow chart showing an ink detection operation in the ink jet print head according to the first embodiment of the invention.
Figure 10A:
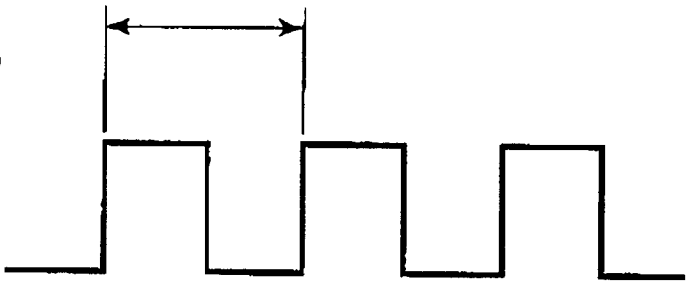
FIG. 10A is signal waveforms for controlling the print element drive timing, in which representing a pulse waveform.
Figure 10B:
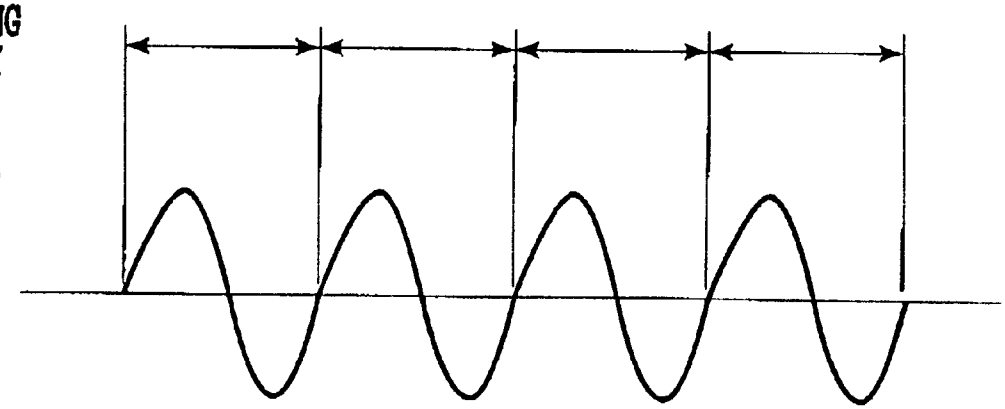
FIG. 10B is signal waveforms for controlling the print element drive timing, in which representing a sine waveform.

FIG. 4 is a plan view showing a schematic configuration of the ink jet print head board of FIG. 3. FIG. 4 shows an rough layout of elements, electrodes and terminals on the board. FIG. 5 is a schematic perspective view showing the ink jet print head board of FIG. 3 and FIG. 4 bonded with a top plate to form ejection ports and nozzles. FIG. 6 is a cross section showing the construction of the ink jet print head board and the nozzle with the top plate bonded to the board. FIG. 6 is a cross section taken along the line a—a of FIG. 5. FIG. 8 shows voltages of various parts on the ink jet print head board when heating elements as the print elements are driven.

FIG. 4 shows the ink jet print head board of this invention as seen from above, mainly illustrating the structural features. As in FIG. 3, reference number 101 in FIG. 4 represents heating bodies (hereinafter referred to as heaters) used as the print elements. The heaters 101 are driven by drivers 102 as drive elements. Denoted 203 are wires connecting one end of the heaters 101 to the drivers 102. A wire 111 feeds a supply voltage to the other end of the heaters 101. As shown in FIG. 6, an electrically insulating protective film 405 (protective layer) is formed over the heaters 101. Cavitation resistant films 205 are laid over the protective film 405 at locations above the heaters 101. FIG. 4 does not show the protective film 405, in order to indicate the arrangement of the heaters 101 and the drivers 102. The ink jet print head explained in this embodiment is of a so-called bubble jet type. The bubble jet print head generates a bubble in the ink in each nozzle by a thermal energy produced when the heater 101 is driven and ejects the ink from the ejection port 310 by the pressure of the growing bubble (see FIG. 5 and FIG. 6). The cavitation resistant film 205 is made from a high melting point metal such as tantalum. This cavitation resistant film 205 prevents an impact generated by the bubble as it contracts after ejecting the ink from being transmitted to the heater 101 and the protective film 405. Designated 118 is an electrode wire for ink detection. Denoted 117 is an external terminal provided at the end of the electrode wire 118 to electrically connect the electrode wire 118 to the outside of the board.

The construction of the ink jet print head board of this embodiment is characterized, as shown in FIG. 4, in that the cavitation resistant films 205 are separated from one another and arranged one for each heater (print element) 101 and that the detection electrode 118 is arranged at a position spaced from the drivers 102 and from the wires 203 between the heaters 101 and the drivers 102. The detection electrode 118 may be formed as a wiring pattern.

In the construction of the ink jet print head board shown in FIG. 4, how the presence or absence of the ink in the nozzle is checked will be detailed in the following by referring to FIG. 5 and FIG. 4.

FIG. 5, as described above, is an outline perspective view showing the top plate 314 bonded to the ink jet print head board 100. As shown in the figure, bonding the top plate 314 to the board 100 forms nozzle portions 408 (see FIG. 6) and a common liquid chamber 311. In FIG. 5, to show the construction of the nozzle portions 408 and the common liquid chamber 311, the upper wall member of the top plate 314 is indicated by dashed lines. Denoted 205 are cavitation resistant films 205 as shown in FIG. 4. As described earlier, the heaters 101 as the print elements are disposed below the cavitation resistant film 205, with the insulating protective film 405 formed therebetween. Hence, in FIG. 5 the heaters 101 are not shown. The drivers 102 for driving the heaters 101 are also not shown in FIG. 5.

In this embodiment, what matters is the relation among the heaters 101 (not shown in FIG. 5) including the cavitation resistant films 205 spaced apart from one another and provided one for each nozzle, the drivers 102 (not shown in FIG. 5), the nozzle portions 408 formed by nozzle walls 312, and the detection electrode 118.

In FIG. 6 the drive power supplied from the power source through the power supply wire 111 is switched by the drivers 102 and fed to the heaters 101 to generate a thermal energy, which in turn generates a bubble in the ink in each nozzle, ejecting the ink from the ejection port 310.

At a stage before the heaters 101 are driven by the switching of the drivers 102, i.e., when the drivers 102 are off, the potentials of various parts are in the following relation. That is, the potential of the heaters 101, the potential of the wires 203 between the heaters 101 and the drivers 102, and the potential of a part of the wires on the drivers 102 (from a portion in each driver 102 that works as a switch to a portion on the heater 101 side) are equal to the potential of the heater power supply wire 111. The ink (which is generally conductive because it contains ions) is electrically floated. That is, the ink is in a high impedance state with respect to ground in terms of a direct current circuit. Hence, the potential of the cavitation resistant films 205 placed on the electrically insulating protective film 405 is electrically floated, as is the ink, i.e., in a high impedance state with respect to ground in terms of a direct current circuit. Similarly, the potential of the detection electrode 118 basically is electrically floated and thus is almost determined by an input impedance of a device which is inserted to detect the potential of the detection electrode 118. In the case of this embodiment, to detect the potential of the detection electrode 118, a voltage monitor M and a resistor of 1M–10MΩ are parallelly connected between the detection electrode 118 and the ground. Therefore, before the heaters 101 are driven, the detected potential is 0V.

When on the other hand the heaters 101 are driven, i.e., when the wires 203 are switched on to connect to the ground by the drivers 102, current flows to the heaters 101. Then, the potential of each heater 101 falls, with the amount of voltage drop increasing toward the drivers 102. And the potential of the wires 203 between the heaters 101 and the drivers 102 and the potential of the part of the wires on the drivers 102 rapidly fall to nearly the ground level. In FIG. 4, an area enclosed by a dashed line A indicates the portion where the voltage falls rapidly when the heaters 101 are driven. It has been found that when the voltage drops in this manner, the protective film 405 that was working as an insulating film in terms of a direct current circuit now functions as a dielectric film of a capacitor, which, as in an AC circuit, transmits a potential change through the protective film 405 to the cavitation resistant films 205 and to the ink on these films 205, the cavitation resistant films 205 spreading from above the heaters 101 toward the drivers 102. Therefore, when the ink exists in the nozzle portions 408 and in the common liquid chamber 311, the potential change is transmitted to the detection electrode 118. When the ink is not present in the nozzle portions 408 and/or the common liquid chamber 311, although the potential change is transmitted to the cavitation resistant films 205, the electric resistances in the nozzle portions 408 and/or the common liquid chamber 311 between the cavitation resistant films 205 and the detection electrode 118 are significantly large. As a result, in the latter case where the ink does not exist, either the potential change that is transmitted to the detection electrode 118 is significantly small or it is not transmitted at all to the detection electrode 118. Therefore, the potential change transmitted to the detection electrode 118 varies depending on the amount of ink or, in extreme cases, the presence or absence of ink in the nozzle portions 408 and the common liquid chamber 311. It is thus possible to detect, based on the potential change, the amount of ink or, in extreme cases, the presence or absence of ink in an area between the driven heaters 101 and the detection electrode 118.

In FIG. 4 and FIG. 6, an area B enclosed by a two-dot chain line represents the portion where the electric resistance changes according to the amount of ink, i.e., the portion that greatly affects the potential change in the detection electrode 118. An area 116 enclosed by a two-dot chain line in FIG. 7 corresponds to the AC-coupled portion in FIG. 5 and FIG. 8.

FIG. 8 is a timing chart to explain the ink detection operation utilizing the above-described detection principle. Denoted 501 is an enable signal that determines the timing at which to drive the heaters 101 and the time during which to keep them driven. The heaters 101 are driven individually and sequentially in synchronism with the enable signal according to a driver control signal (not shown). Denoted 503 is a potential of the wires 203 between the heater 101 and the driver 102. As the potential 503 changes, so do the potential of a part of each heater 101 near the driver 102 and the potential of a part of the wires on the driver 102 (from the portion within the driver 102 working as a switch to the portion on the heater 101 side). A region including these components where the voltage changes is called a voltage change region. In the heaters 101, the potential change amplitude varies depending on the location, with the amplitude increasing toward the drivers 102. The surface potential of the protective film 405 is considered to be almost equal to the potential of the voltage change region below. Designated 504 and 505 are ink detection signals produced by the potential change of the detection electrode 118. The detection signal 504 is the one produced when the ink exists in the area B in FIG. 4; and the detection signal 505 is the one produced when the ink does not exist in the area B. When there is ink in the area B, the electric resistance of the area B is small, which means that the potential change detected by the detection electrode 118 and therefore the change in the detection signal 504 are large. When on the other hand there is no ink in the area B, the electric resistance of the area B is large. Hence, the potential change detected by the detection electrode 118 and therefore the change in the detection signal 504 are small. It is seen therefore that, depending on whether or not the area B has ink, the detection signal produced by the detection electrode 118 changes. The detection signal produced by the detection electrode 118 also changes according to the amount of ink present in the area B.

By time-dividing the detection signal from the detection electrode 118 according to the drive timing of the heaters 101, it is possible to determine the amount of ink or, in extreme cases, the presence or absence of ink for each nozzle driven. The detection signal 504 in FIG. 8 represent the one when there is ink in all the nozzles driven. The detection signal 505 in FIG. 8 is the one when there is no ink in any of the nozzles driven. Hence, when one of the nozzles driven has no ink, only the detection signal corresponding to that driven nozzle appears as a detection signal 505 with a small change. The detection signals corresponding to other driven nozzles appear as detection signals 505 with a large change.

In this embodiment, the cavitation resistant films 205 are separated from one another and matched to the corresponding heaters 101 so that the potential change for each nozzle can be detected reliably according to the presence or absence of ink without being affected by the adjoining nozzles.

Further, in this embodiment, not only are the cavitation resistant films 205 separated from one another and matched to the corresponding heaters 101 but the detection electrode 118 on the detection side is also used commonly for all nozzles. With this arrangement, driving the nozzles sequentially in a time division manner can determine the presence or absence of ink in each of the arrayed nozzles by using detection signals from the single detection electrode 118.

Further, the heaters 101 themselves can be used as signal sources for the ink detection signals. This enables a logic circuit, which has conventionally been formed in the print head to provide a shift register or the like, to be used in determining the presence or absence of ink for each nozzle. With this invention, therefore, a check on the presence or absence of ink can be made with a very simple construction without complicating it.

The detection of the state of ink by using the print head board can be applied to a variety of nozzle drive systems. In other words, the detection signals from the detection electrode 118 can be matched to the driven nozzles according to the nozzle drive system to check the presence or absence of ink for each driven nozzle. Examples of the nozzle drive systems that can employ the ink state detection method of this invention include a generally known block drive system which drives a block of nozzles at a time. In that case, the ink presence or absence is checked for each block of nozzles based on the detection signal from the single detection electrode 118.

The cavitation resistant films 205 may be provided without being separated for a predetermined number of nozzles. For example, when the nozzles are driven in blocks, the cavitation resistant films 205 may not be separated for a plurality of nozzles in the same block or for a predetermined number of nozzles spanning different blocks. Further, in addition to the arrangement in which the detection electrode 118 is provided commonly for all of a plurality of nozzles formed in the board 100, it is possible to use two or more detection electrodes, each covering a predetermined number of nozzles.

Further, the board 100 and the top plate 314 need only to form a nozzle for each print element or for each two or more print elements. The ink jet recording apparatus may use the ink detection signal in controlling the printing operation.

In this embodiment, the ink detection operation is performed as follows for higher reliability and higher precision. The ink state detection operation in this embodiment will be explained by referring to the flow chart of FIG. 9.

At a predetermined ink state detection operation timing, for example, immediately before the start of the recording operation, the main controller 11 outputs an ink state check instruction (ink detection instruction) to the driver controller 17 (step 301). Upon reception of this ink detection instruction, the driver controller 17 activates the print element pattern drive control means (periodical drive means) 19 (step 302) and issues an ink state check start instruction to the in-nozzle state check means 20 (step 303). At the same time, the print element pattern drive control means 19 supplies to the drivers 102 at a predetermined timing a pattern signal having a predetermined frequency set according to the frequency characteristic of the conductive ink 50 (step 304). The print elements 101 therefore are driven in synchronism with the pattern signal (step 306). As a result, the detection signals with levels corresponding to the ink supply state in the nozzles are output from the detection electrode 118 on the board 100 at a predetermined timing corresponding to the drive timing of the print elements 101 (step 307).

The ink state check start instruction (step 303) activates the in-nozzle state check means 20 (step 305) which executes the subsequent steps 308 and 309. The step 308 samples the detection output from the detection electrode 118 at a timing in synchronism with the drive timing of the print elements 101. Next, according to the level of the sampled detection output, it is checked which of the two preset patterns matches the output pattern from the detection electrode (step 309). The result of this check is transferred to the main controller 11 (step 310).

Now, the operations of the print element pattern drive control means 19 and the in-nozzle state check means 20 will be described in more detail.

In the ink jet print head board 100 of the first embodiment, the voltage change that occurs between the print elements 101 and the drivers 102 can be detected through the conductive ink 50 present on the protective film 405. In this ink jet print head board 100, however, when the nozzles have no ink, there is an infinitely large impedance between the voltage change region, which lies between the print elements 101 and the drivers 102, and the detection electrode 118. Hence, the voltage change is hardly transmitted to the detection electrode 118. When, on the other hand, the nozzles have a sufficient supply of ink, the voltage change that occurs in the voltage change region between the print elements 101 and the drivers 102 can be detected and transmitted to the detection electrode 118 by the conductive ink, thus allowing the ink state to be detected.

Generally, the DC resistance of the conductive ink 50 is very large between several hundred kΩ and several hundred MΩ. If the print elements 101 are driven DC-wise, even when a sufficient volume of the conductive ink 50 exists in the nozzles, the voltage change can only be detected in a very small amplitude. This may give rise to an error in the ink state detection operation. Hence, during the ink state detection operation, the impedance of the conductive ink 50 needs to be set small for the voltage change to be detected in a large amplitude by the detection electrode 118.

Under these circumstances, the first embodiment focuses on the fact that the impedance of the conductive ink 50 is small and constant in a certain frequency band and takes advantage of this characteristic of the conductive ink in determining the construction. That is, in the first embodiment, the driver controller 17 has the print element pattern drive control means 19 to control the drivers during the ink state detection operation. When it receives an ink state detection instruction from the main controller 11, the print element pattern drive control means 19 drives the print elements 101 by using a signal pattern that has a frequency in that frequency band in which the impedance of the conductive ink 50 is small and constant. Example signal patterns for driving the print elements include a pulse wave pattern shown at 401 in FIG. 10A and a sine wave pattern shown at 402 In FIG. 10B.

By setting the drive frequency of the print elements as described above to minimize the impedance of the conductive ink, it is possible to increase the difference between the detected voltages produced when the conductive ink 50 exists in the nozzles and when it does not. This in turn allows the presence or absence of the conductive ink 50 in the nozzles of the print head board 100 to be detected more reliably and precisely.

Here, experiments conducted on different kinds of conductive inks A, B, C and D to determine the relationship between the amount of ink and the electric characteristic of the ink as well as their results will be explained by referring to FIG. 14 to FIG. 21.

Experiments

First, a container 803 measuring 65 mm×42 mm×40 mm was prepared and an electrode measuring 25 mm×10 mm installed vertically in this container 803. Then, by changing the frequency in the range between 100 Hz and 40 MHz, measurements were made of the impedance Ω of the conductive ink in the container 803 for the following conditions of experiments ((1)–(4)).

Figure 14:
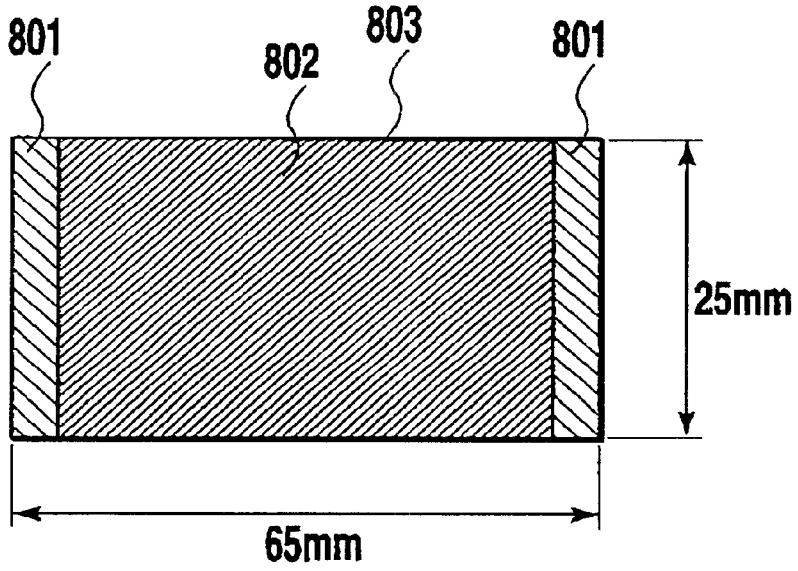
FIG. 14 is an explanatory view showing an electric characteristic experiment (1) on a conductive ink applied to the invention.
Figure 15:
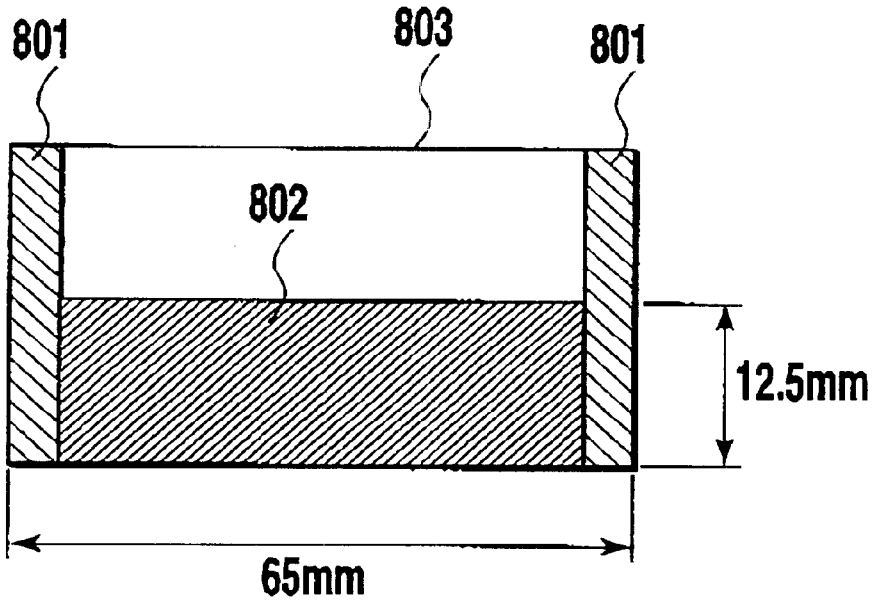
FIG. 15 is an explanatory view showing an electric characteristic experiment (2) on the conductive ink applied to the invention.
Figure 16:
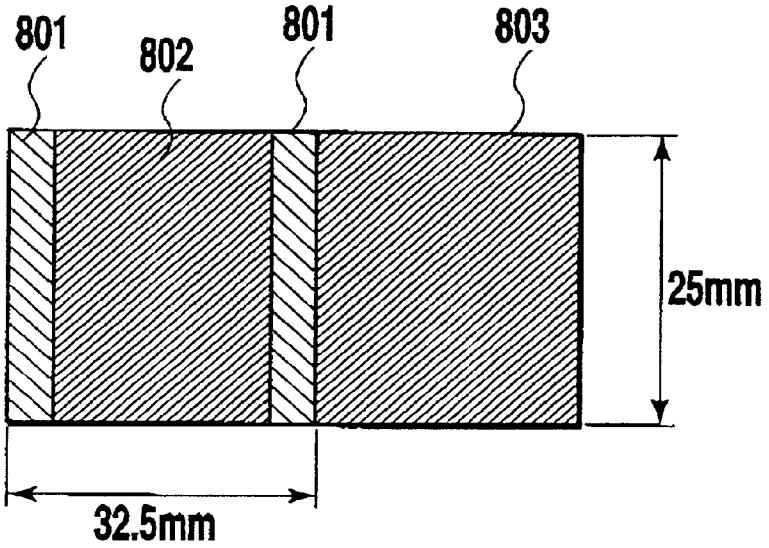
FIG. 16 Is an explanatory view showing an electric characteristic experiment (3) on the conductive ink applied to the invention.
Figure 17:
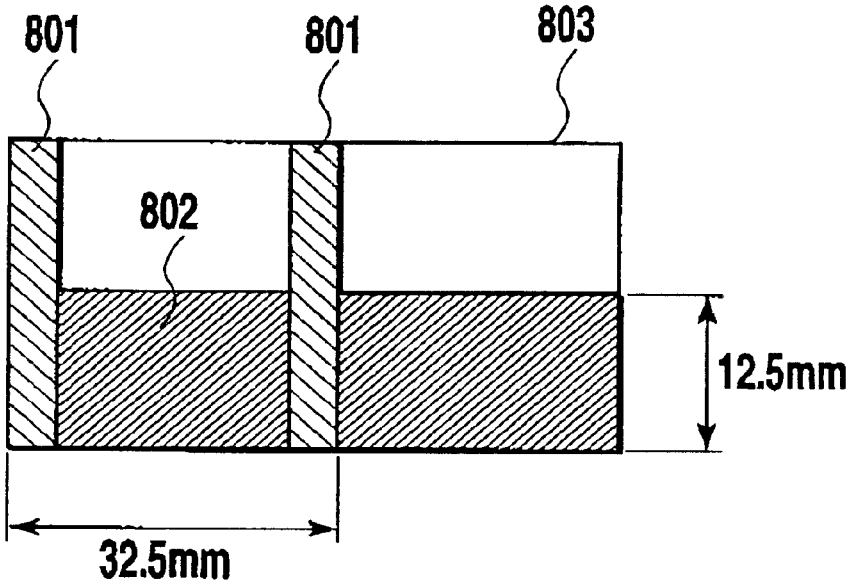
FIG. 17 is an explanatory view showing an electric characteristic experiment (4) on the conductive ink applied to the invention.
Figure 18:
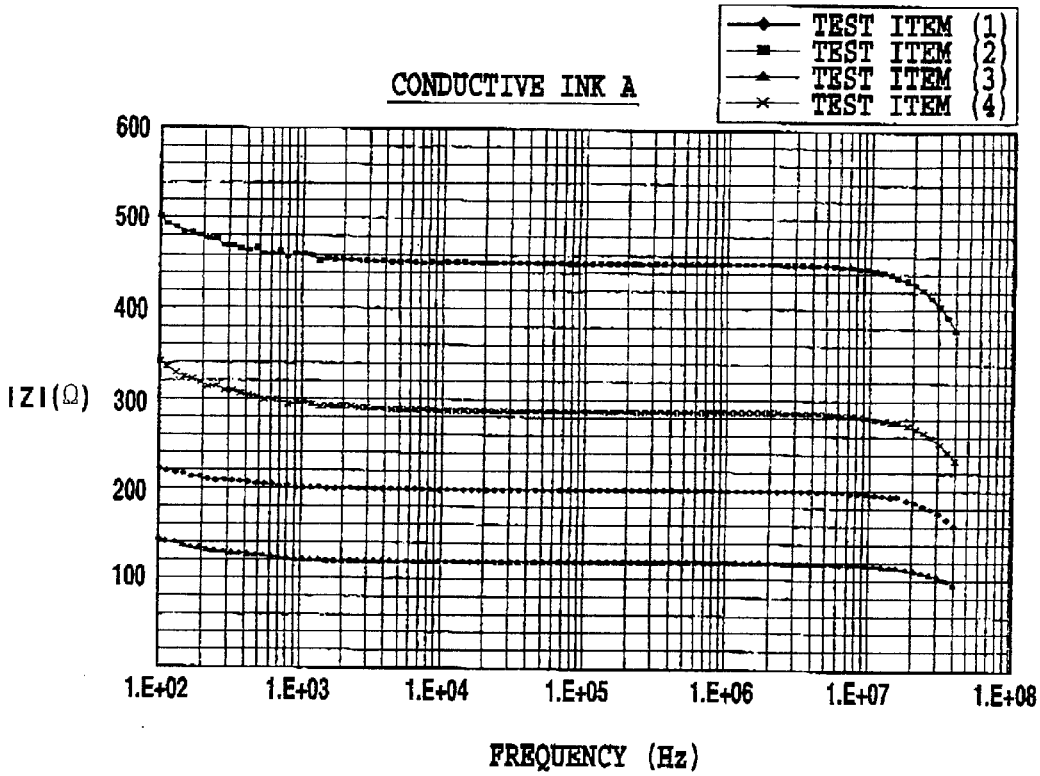
FIG. 18 is an explanatory diagram showing a frequency-impedance characteristic for a conductive ink A.
Figure 19:
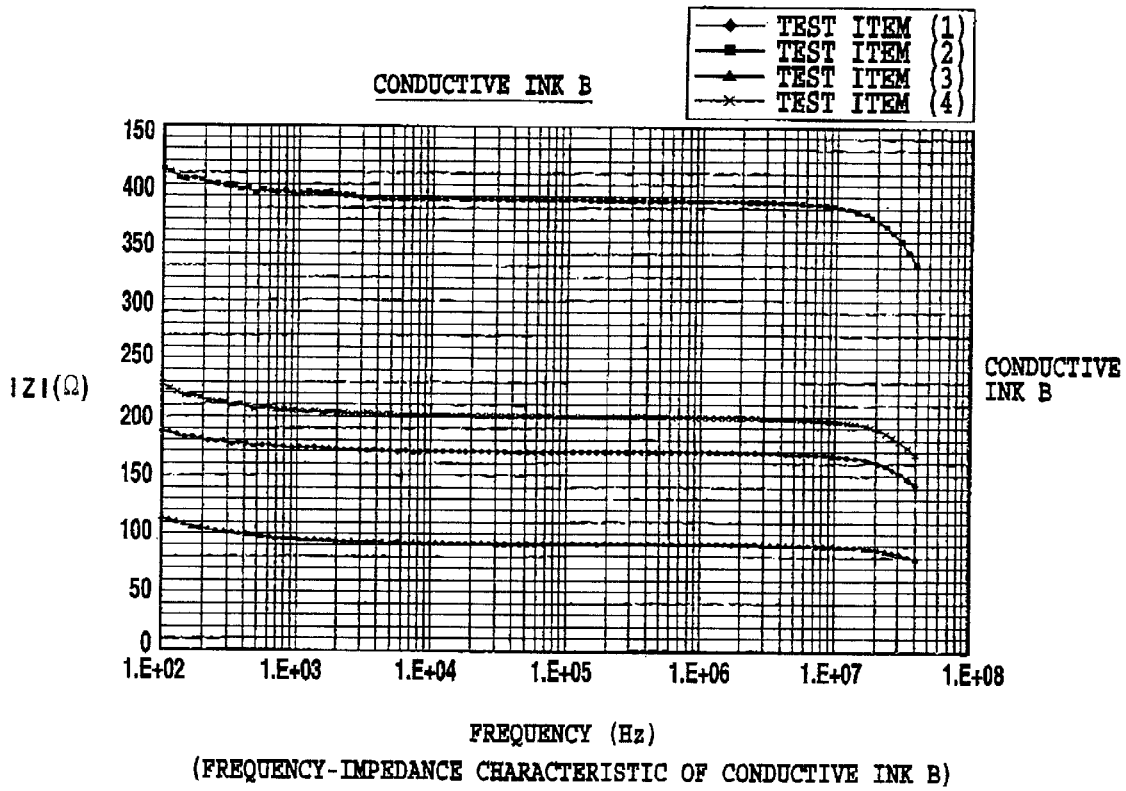
FIG. 19 is an explanatory diagram showing a frequency-impedance characteristic for a conductive ink B.
Figure 20:
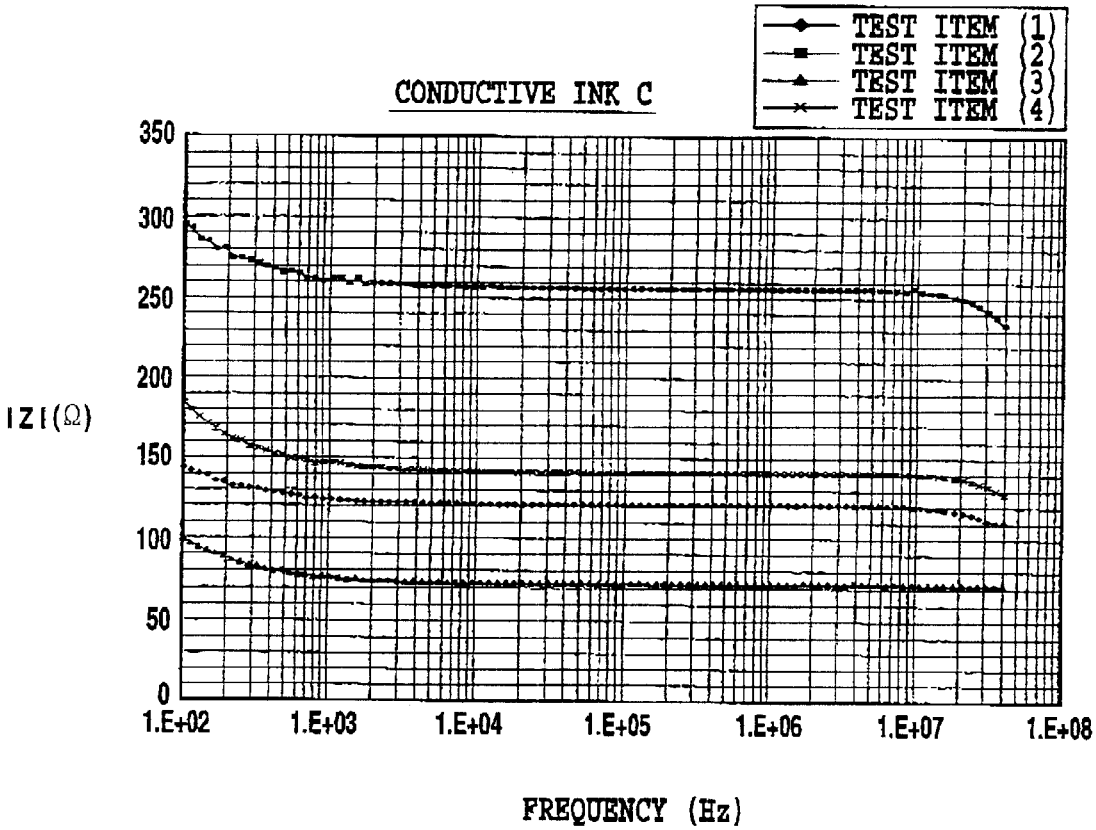
FIG. 20 is an explanatory diagram showing a frequency-impedance characteristic for a conductive ink C.
Figure 21:
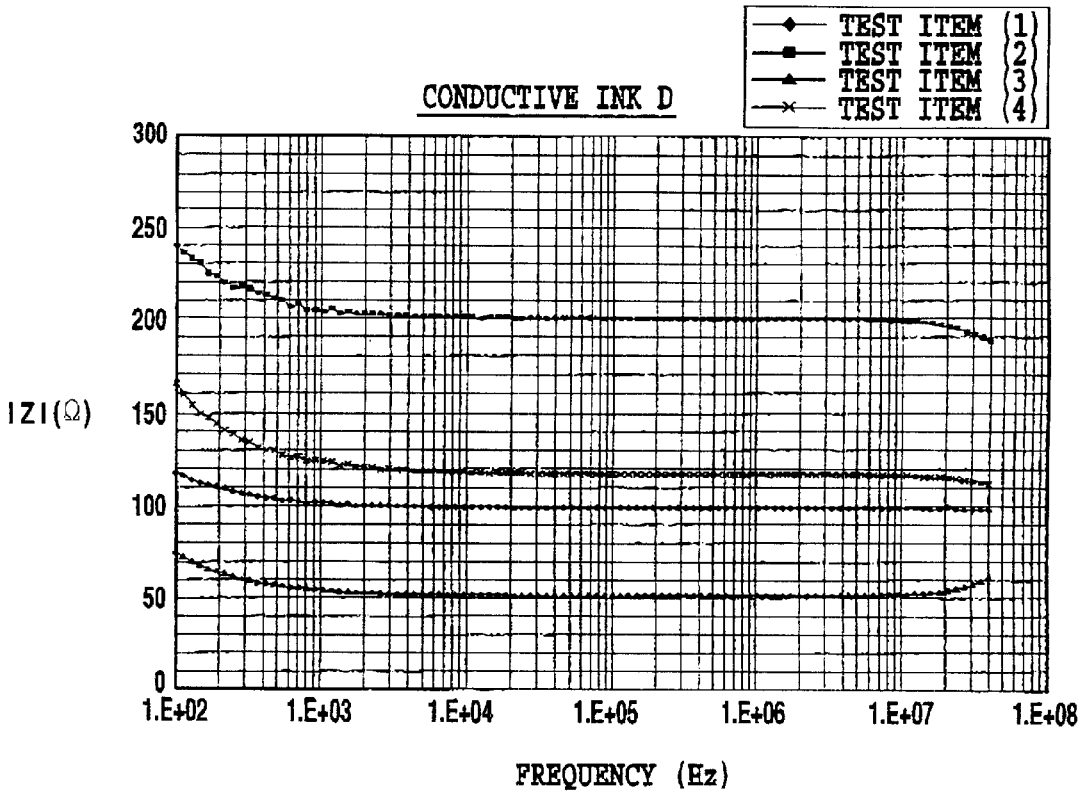
FIG. 21 is an explanatory diagram showing a frequency-impedance characteristic for a conductive ink D.

(1) The impedance measurements were taken by setting the conductive ink level to 25 mm and the electrode width to 65 mm (see FIG. 14);

(2) The impedance measurements were taken by setting the conductive ink level to 12.5 mm and the electrode width to 65 mm (see FIG. 15);

(3) The impedance measurements were taken by setting the conductive ink level to 25 mm and the electrode width to 32.5 mm (see FIG. 16); and (4) The impedance measurements were taken by setting the conductive ink level to 12.5 mm and the electrode width to 32.5 mm (see FIG. 17).

The results of impedance measurements for the conductive inks (A, B, C, D) in the experiments (1) to (4) are shown in FIGS. 18, 29, 20 and 21. These figures show that when the frequency is varied from a low frequency (100 Hz) to a high frequency (40 MHz) for each conductive ink (A, B, C, D), the impedance value gradually decreases as the frequency increases until it is constant in a frequency band higher than a predetermined frequency, with the impedance value thereafter increasing or decreasing. Similar experiments were also conducted on various other conductive inks and similar results to those described above were obtained. After the impedance becomes constant, the electrical behavior slightly varies depending on the kinds of conductive inks but their characteristics before the impedance becomes constant are almost identical. Based on these experimental results, the impedance-frequency characteristic of the conductive ink 50 can be modeled as shown in FIG. 11.

Figure 11:
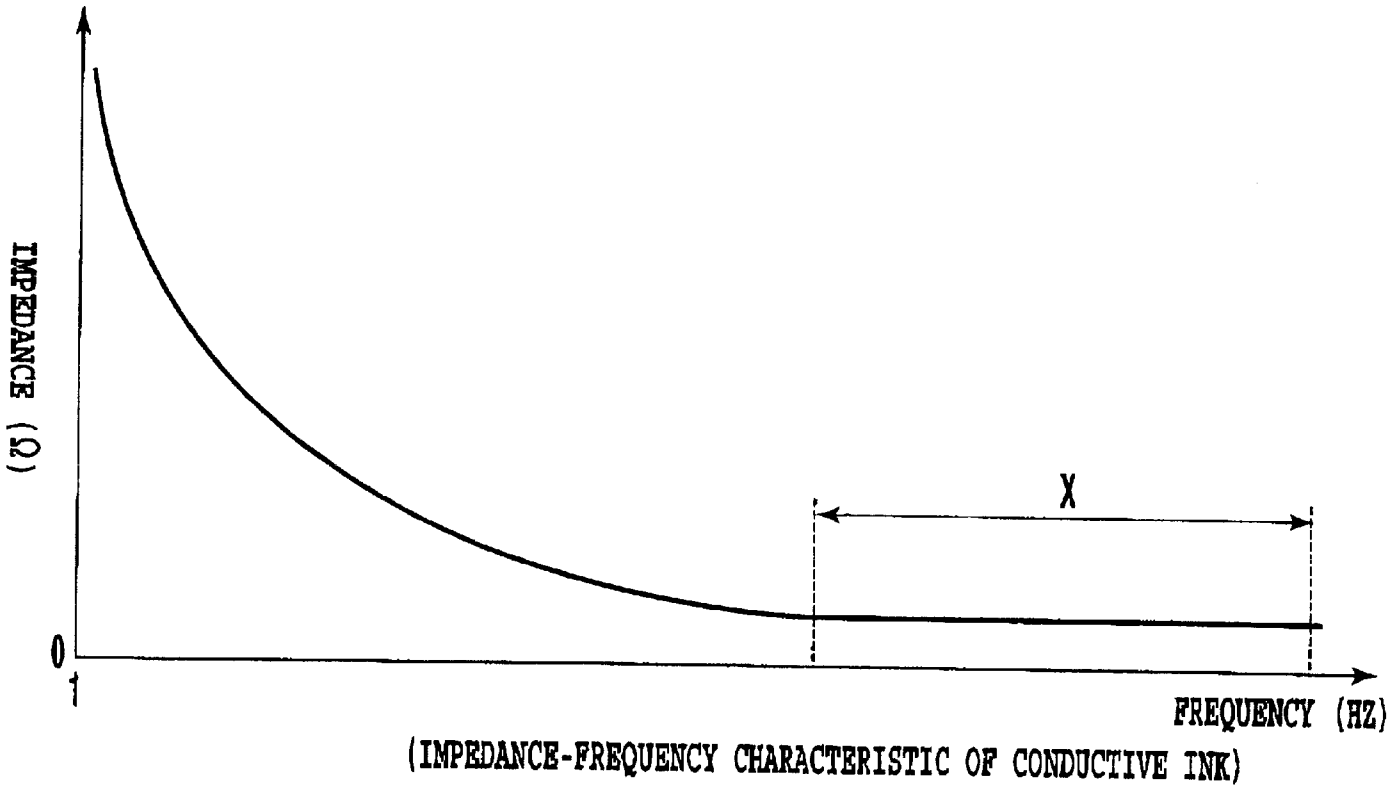
FIG. 11 is a graph showing a model of an impedance-frequency characteristic of a conductive ink.

FIG. 11 shows that in the ink jet print head board 100 the impedance is stable and lowest in the frequency band indicated at X. Hence, when the print elements 101 are driven in this frequency band X, the voltage drop due to the ink in the nozzles becomes smallest, making largest the difference between the detection signals produced when there is no conductive ink 50 in the nozzles and when there is a sufficient volume of the conductive ink 50.

Next, the in-nozzle state check means 20 will be explained. The in-nozzle state check means 20 periodically detects a level of the output signal from the detection electrode 118 at a predetermined timing. Based on the level of the detection signal, the in-nozzle state check means 20 checks which of the two detection signal patterns with different levels matches the output pattern from the detection electrode 118, and sends the check result to the main controller 11. Hence, the in-nozzle state check means 20 functions as a periodical voltage detection means and as an ink state check means.

Figure 12:
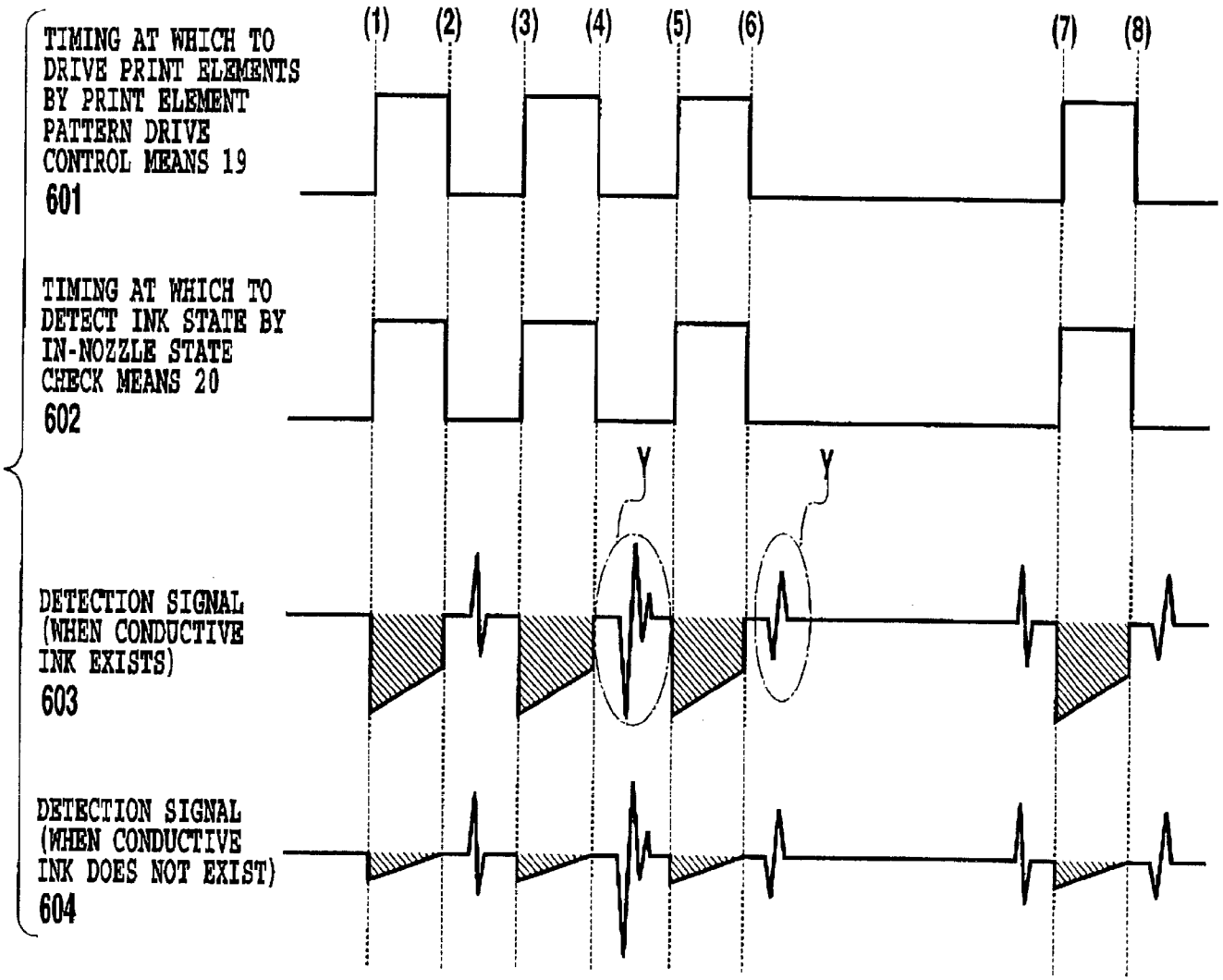
FIG. 12 is a timing chart showing a print element drive timing, an ink state detection timing and a detection signal in the first embodiment of the invention.

In this first embodiment, denoted 601 in FIG. 12 is a drive pattern to control the timing at which the print element pattern drive control means 19 drives the print elements 101. This drive pattern is set according to the frequency characteristic of the conductive ink 50. Reference numbers 603 and 604 in FIG. 12 denote waveforms of detection signals output from the detection electrode 118 in the ink jet print head board 100.

In addition to the voltage changes associated with the presence or absence of the conductive ink 50 in the nozzles, the signals output from the detection electrode 118 often include logic noise from the ink jet print head board 100 and other internally and externally caused noise, as indicated at Y in FIG. 12, during the output of off-signals. When the signal containing such noise is used in checking the presence or absence of the ink, there is a possibility of a check result different from the actual ink state in the nozzles being produced. That is, the ink detection may produce an error.

For this reason, the print element pattern drive control means 19 drives the print elements 101 according to a pattern that matches the frequency characteristic of the conductive ink 50. At timings synchronous with this pattern (timings (1)–(8) of 602 in FIG. 12), output signals are detected from the detection electrode 118 to sample the shaded portions of the signal waveforms of 603 and 604 in FIG. 12. Then, it is checked whether the output pattern detected from the detection electrode 118 is a predetermined pattern that matches the state of the conductive ink 50 in the nozzles (whether the conductive ink 50 exists or not). The check result is output to the main controller 11.

When an aperiodic detection is made in a noise-laden condition in or out of logic circuits, it is difficult to tell whether the signal obtained is one containing noise components or one produced as a result of normal detection. The result of detection therefore is not reliable.

However, driving the print elements according to a predetermined pattern and performing a periodic detection according to that pattern as explained in the embodiment above can make the ink detection susceptible to influences of noise, thereby realizing an accurate in-nozzle state detection.

Second Embodiment

Next, a second embodiment of this invention will be described.

In the second embodiment the in-nozzle ink state detection (checking whether there is ink or not) is performed by considering the fact that a certain period of time t elapses after the print element pattern drive control means 19 has actually driven the print elements 101 until the detection output is obtained from the detection electrode 118 through the conductive ink 50. In other respects, the construction is similar to that of the first embodiment.

Figure 13:
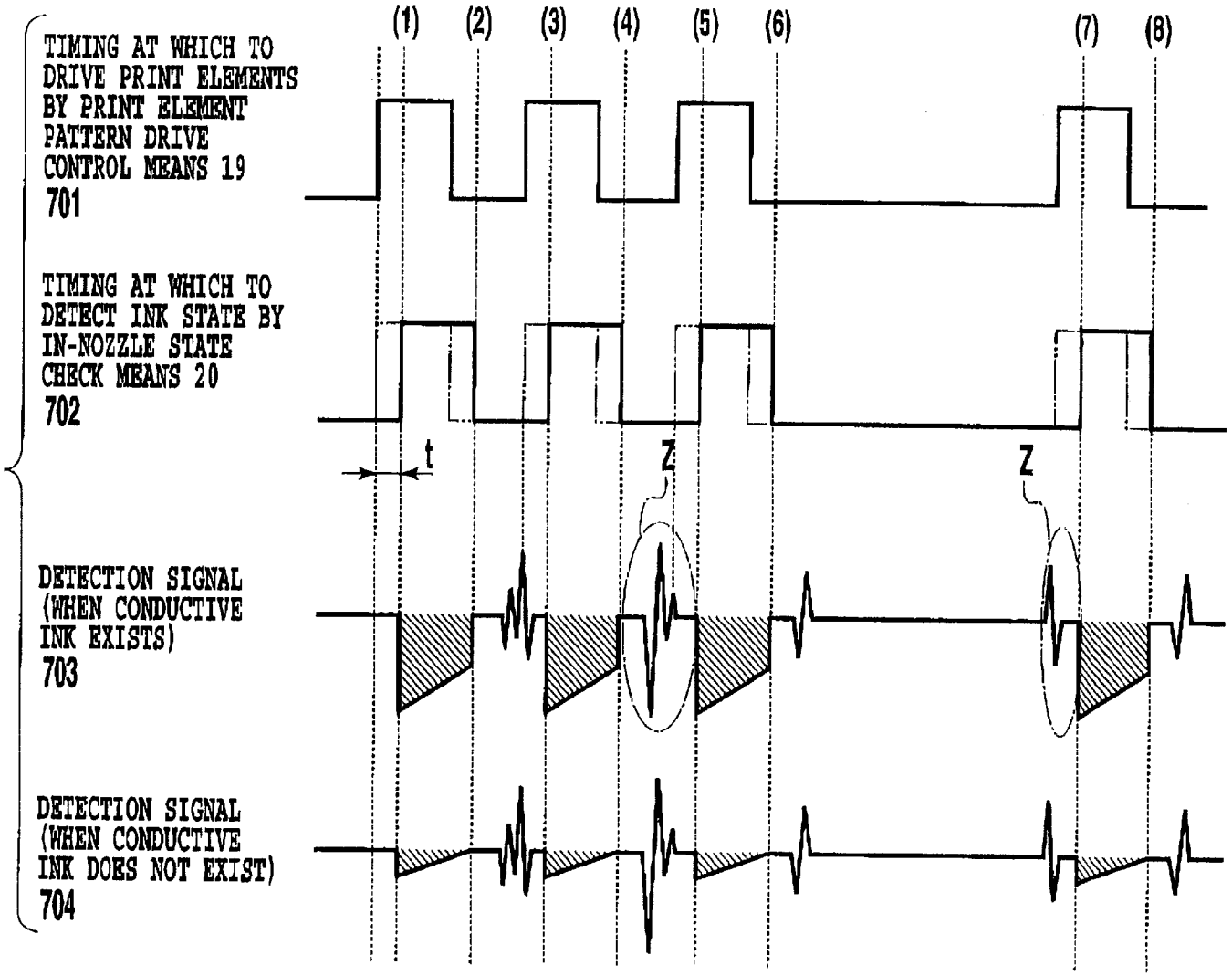
FIG. 13 is a timing chart showing a print element drive timing, an ink state detection timing and a detection signal in the second embodiment of the invention.

In the first embodiment the output signal from the detection electrode 118 is picked up at a timing that completely matches the timing at which the print element pattern drive control means 19 drives the print elements 101 according to the drive pattern conforming to the frequency characteristic of the conductive ink 50. In the second embodiment, however, as shown in FIG. 13, the signal detection is performed at a timing that is delayed by the time t from the drive timing of the print elements 101. This allows the ink detection operation to be performed more accurately.

Suppose that there is a time delay t from the moment the print elements 101 are driven to the moment the detection output of the detection electrode 118 is obtained. If, despite this time delay t, the drive timing of the print elements 101 and the detection timing of the detection electrode are completely matched, as in the first embodiment, there is a possibility that noise (see Z in FIG. 13) unrelated to the actual ink state which is produced when the print elements are off may be detected. The second embodiment, on the other hand, takes into account the time delay t and performs the detection at a timing whose period is the same as the print element driving period (at timings (1)–(8) of a solid line waveform 702 in FIG. 13). As a result, the shaded portions of the waveforms 703 and 704 in FIG. 13 are sampled, thus avoiding noise when checking the presence or absence of ink.

The second embodiment therefore can be expected to provide a better signal-to-noise ratio than the first embodiment, making it possible to perform a more precise in-nozzle state detection.

In the first and second embodiments, the print element drive frequency used in performing the in-nozzle state detection is selected from within a frequency band X in FIG. 11 in which the impedance of the ink is constant. The print element drive frequency should preferably be set as high as possible within the frequency band X. This is because a higher frequency is advantageous in synchronizing the print element drive timing with the timing at which to output the detection signal from the detection means.

Other Embodiments

In the preceding embodiments, the detection electrode 118 is located at a position spaced from the drivers 102, as shown in FIG. 6. In the construction shown in FIG. 6, the protective film 405 is formed to have an almost uniform thickness. This invention, however, is not limited to the construction of FIG. 6. For example, the portions that work as signal sources and cause potential changes in the nozzles when the heaters 101 are driven may adopt other constructions.

Figure 22A:
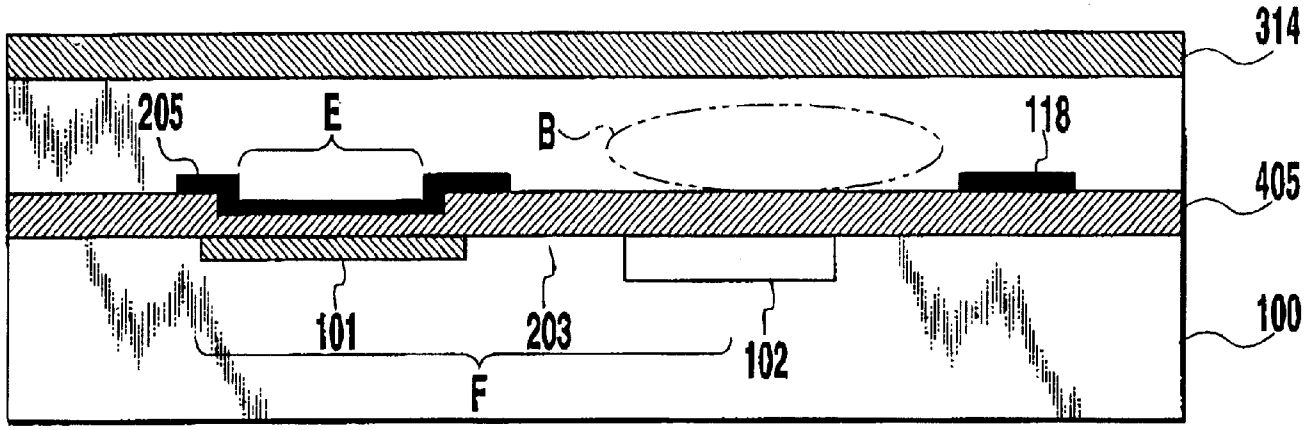
FIGS. 22A and 22B are cross sections of a nozzle and its associated components in the ink jet print head according to a further embodiment of the invention.

FIG. 22A shows another construction (third embodiment of the invention) which differs from the construction of FIG. 6 in that portions E of the protective film 405 situated above the heaters 101 are made thinner than other portions of the protective film 405. The construction of FIG. 22A can increase the electrostatic capacitance of the portion E of the protective film 405 with the reduced thickness, which in turn increases the potential change transmitted to the ink in the nozzles, thus enhancing the sensitivity of the ink detection that uses the detection signal from the detection electrode 118. Because of its large electrostatic capacitance, the portions E can be a particularly strong signal source in an ink detection signal source region F. The signal source region F includes a part of the heater 101 on the driver 102 side, the wires 203 and a part of the wires on the driver 102 (from the portion within the driver 102 working as a switch to the portion on the heater 101 side), and constitutes the voltage change region. It is therefore possible to reliably determine whether the ink exists or not in an area B in the nozzle between the portion E and the detection electrode 118.

Figure 22B:
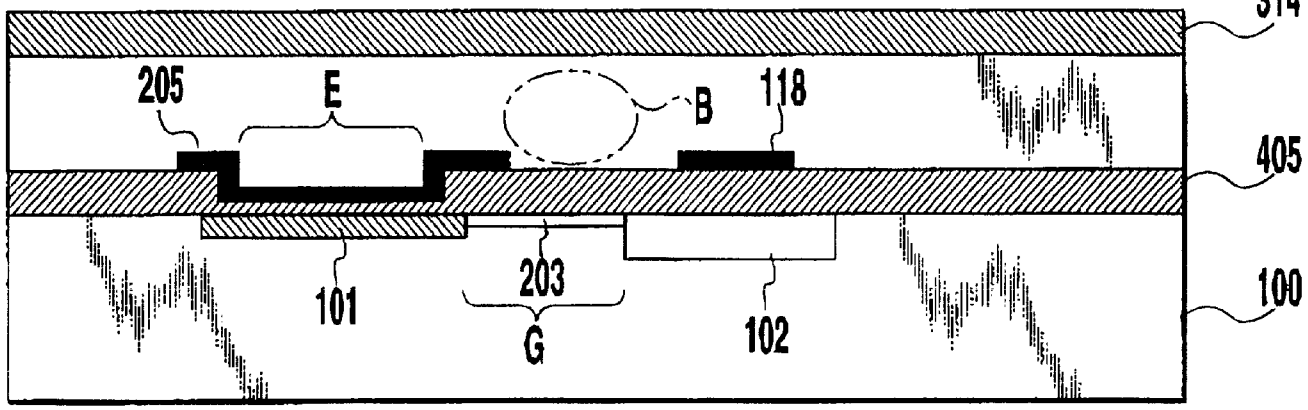

FIG. 22B shows still another construction (fourth embodiment of the invention), which is characterized in that portions E of the protective film 405 situated above the heaters 101 are made thinner than other portions of the protective film 405 and that the detection electrode 118 is arranged above the drivers 102. It should be noted that the portion E of the protective film 405 in FIG. 22B is formed thinner than the corresponding part in FIG. 22A. In the construction of FIG. 22B, by reducing the thickness of the protective film 405 at the portions E above the heaters 101, the electrostatic capacitance in the portions E can be made larger than that of the wire 203 portion between the heaters 101 and the drivers 102. Symbol G In FIG. 22B represents a signal source provided by the wire 203 portion. Further, arranging the detection electrode 118 above the drivers 102 to bring the detection electrode 118 closer to the portion E can detect the presence or absence of the ink in a localized area B between the detection electrode 118 and the portion E.

Figure 23:
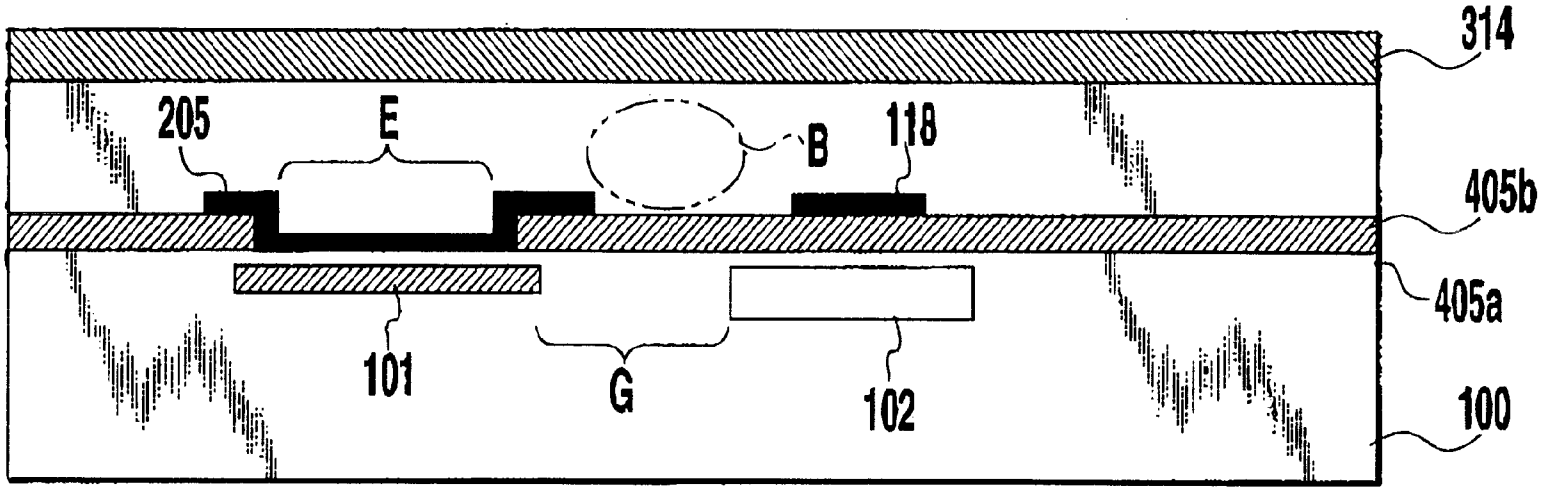
FIG. 23 is a cross section of a nozzle and its associated components in the ink jet print head according to a further embodiment of the invention.

FIG. 23 shows a further construction (fifth embodiment of the invention) in which the portions E of the protective film 405 located above the heaters 101 have a reduced thickness. In FIG. 23, the protective film 405 is made up of two protective films 405*a*, 405*b* and the cavitation resistant films 205 above the heaters 101 are formed on the protective film 405*a*. Further, the relative dielectric constants of the protective films 405*a* and 405*b* are differentiated. More specifically, the protective film 405*a* is formed of a member with a higher dielectric constant than that of the protective film 405*b*. With the protective film 405*a* above the heaters 101 formed thinner and having a higher dielectric constant as described above, the portion E becomes a stronger signal source, further enhancing the detection sensitivity.

As described above, reducing the thickness of those portions of the protective film which are situated above the heaters and increasing the dielectric constant of those portions of the protective film can enhance the energy transmission efficiency of the protective film above the heaters. With this construction, the heater portion can be made to act as a stronger signal source thereby allowing the area of a signal source to be limited to a particular localized portion above the heater.

Further, by making it difficult for other portions except above the heaters to act as signal sources, the ink detection can be made less susceptible to influences of noise that may cause erroneous detection. This in turn enhances the sensitivity and precision of the ink detection Further, by limiting the area of a signal source to a particular location, it is possible to flexibly arrange the detection electrode over the drivers. Hence, applying the construction of either FIG. 22A, (b) or FIG. 23 to the first and second embodiments can realize both an increased level of a signal from the signal source and a reduced impedance of the conductive ink at the same time, making it possible to perform the in-nozzle ink state detection with an excellent precision.

In the above embodiments we have described as an example the bubble jet recording system that uses heaters as print elements to eject ink. However, detection through the ink of a voltage change produced as a result of driving the print elements is also possible with other recording systems. This invention therefore is widely applicable to other recording systems as well as the bubble jet recording system.

Further, in the constructions described above, we have described as an example the ink jet print head board which has the cavitation resistant films formed above the heaters to minimize the impact produced by a bubble as it contracts. It is, however, possible to apply the detection principle of this invention to those print head boards without cavitation resistant films as long as they use the conductive ink.

Others

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

As described above, this invention can detect through the ink a change in the voltage between the print elements and the driver elements which is produced as a result of driving the print elements, and thereby determine the state of ink in the print head with a very simple construction according to the relation between the detection result and the amount of ink in the print head. Further, in this invention, when sampling the detected voltage, the drive frequency of the print elements is set to an optimum frequency according to the impedance-frequency characteristic of the conductive ink. At the same time, the detected voltage is sampled at a timing corresponding to the drive frequency of the print elements and, based on the voltage value of the sampled detected voltage, a decision is made as to whether there is ink or not. This arrangement makes it possible to detect the state of ink in the print head or more precisely the in-nozzle ink state with high precision and thereby perform the recording operation properly.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet recording apparatus having an ink jet print head board mounted on an ink jet print head, the ink jet print head ejecting a conductive ink from ejection ports to perform printing, the ink jet print head board comprising:

print elements for supplying energy to eject the ink;

drive elements for driving the print elements;

an insulating protective film formed to cover wires connecting the print elements and the drive elements;

a detection electrode capable of detecting, through the ink on the ink jet print head board, an electric potential between signal sources and the drive elements, said signal sources being for signals generated according to the driving of the print elements, and said signals being generated through said insulating protective film;

periodical drive means for driving the print elements at a predetermined drive frequency;

voltage detection means for periodically detecting an output voltage of the detection electrode at a timing corresponding to the drive frequency; and state check means for checking a state of the ink jet print head according to a result of the detection by the voltage detection means.

2. An ink jet recording apparatus according to claim 1, wherein an impedance of the ink has a frequency characteristic.

3. An ink jet recording apparatus according to claim 2, wherein the impedance of the ink is constant and lowest in a predetermined frequency band.

4. An ink jet recording apparatus according to claim 2, wherein the periodical drive means drives the print elements at a frequency corresponding to the frequency characteristic of the conductive ink.

5. An ink jet recording apparatus according to claim 2, wherein the state check means determines whether or not a sufficient amount of the ink to enable appropriate ink ejection is supplied to the ink jet print head board by checking whether the detected voltage output from the voltage detection means is higher than a predetermined voltage value.

6. An ink jet recording apparatus according to claim 1, wherein the detection electrode is spaced from a voltage change region between the printing elements and the drive elements whose voltage changes as the print elements are driven.

7. An ink jet recording apparatus according to claim 1, wherein the detection electrode is provided common to a plurality of the print elements.

8. An ink jet recording apparatus according to claim 1, wherein the detection electrode is provided common to all of a plurality of the print elements installed on the ink jet print head board.

9. An ink jet recording apparatus according to claim 1, wherein a transmission of the voltage change between the ink and the voltage change region between the print elements and the drive elements is accomplished by a capacitive coupling.

10. An ink jet recording apparatus according to claim 9, wherein the protective film is formed to partially change the capacitive coupling between the voltage change region and the ink, and the detection electrode is spaced from a large capacitive coupling portion with a small capacitive coupling portion therebetween and is provided between the print elements and the drive elements.

11. An ink jet recording apparatus according to claim 10, wherein the large capacitive coupling portion comprises thin portions of the protective film situated above the print elements.

12. An ink jet recording apparatus according to claim 1, wherein the print elements comprise heating elements that generate respective bubbles in the ink to eject the ink.

13. An ink jet recording apparatus according to claim 12, wherein the protective film includes cavitation resistant films to minimize a cavitation impact caused when a bubble in the ink vanishes.

14. An ink jet recording apparatus according to claim 13, wherein the cavitation resistant films comprise tantalum films.

15. An ink jet recording apparatus according to claim 13, wherein the cavitation resistant films are separated by n print elements, where n is a predetermined number.

16. An ink jet recording apparatus according to claim 13, wherein portions of the protective film above the print elements are set to have a larger electrostatic capacitance per unit area than other portions, and the cavitation resistant films are formed on these portions of the protective film above the print elements.

17. An ink jet recording apparatus according to claim 13, wherein the portions of the protective film above the print elements are formed thinner than other portions.

18. An ink jet recording apparatus according to claim 1, wherein the ink jet print head board is formed with a control circuit to selectively drive a plurality of the print elements.

19. An ink jet recording apparatus according to claim 18, wherein the control circuit includes a shift register to parallelly output serially input print data.

20. An ink jet recording apparatus according to claim 18, wherein the control circuit includes a latch circuit to temporarily hold the parallelly output print data.

21. An ink jet print head comprising:

(a) an ink jet print head board comprising:

print elements for supplying energy to eject a conductive ink;

drive elements for driving the print elements;

an insulating protective film formed to cover wires connecting the print elements and the drive elements;

a detection electrode capable of detecting, through the ink on the ink jet print head board, an electric potential between signal sources and the drive elements, said signal sources being for signals generated according to the driving of the print elements, and said signals being generated through said insulating protective film;

periodical drive means for driving the print elements at a predetermined drive frequency;

voltage detection means for periodically detecting an output voltage of the detection electrode at a timing corresponding to the drive frequency; and state check means for checking a state of the ink jet print head according to a result of the detection by the voltage detection means; and (b) a top plate combined with the ink jet print head board to form nozzles each corresponding to a predetermined number of the print elements.

22. An ink jet print head according to claim 21, wherein cavitation resistant films are separated from one another and have a one-to-one correspondence with the nozzles.

23. An ink jet print head according to claim 21, wherein the top plate is combined with the ink jet print head board to form a common liquid chamber communicating with the plurality of the nozzles, and at least a part of the detection electrode is situated inside the common liquid chamber.

* * * * *